US007980875B2

(12) United States Patent
Gosis et al.

(10) Patent No.: US 7,980,875 B2
(45) Date of Patent: Jul. 19, 2011

(54) AIRCRAFT ELECTRICAL CONNECTOR WITH DIFFERENTIAL ENGAGEMENT AND OPERATIONAL RETENTION FORCES

(75) Inventors: Anatoly Gosis, Palatine, IL (US); Scott Takayuki Koizumi, Upton, MA (US); Folkert Fred Koch, San Ramon, CA (US); Wolfgang Ott, Antioch, CA (US); Christopher A. Tacklind, Menlo Park, CA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/645,451

(22) Filed: Dec. 22, 2009

(65) Prior Publication Data

US 2010/0197159 A1 Aug. 5, 2010

Related U.S. Application Data

(63) Continuation-in-part of application No. 11/681,674, filed on Mar. 2, 2007.

(60) Provisional application No. 60/781,842, filed on Mar. 13, 2006.

(51) Int. Cl.
*H01R 13/15* (2006.01)

(52) U.S. Cl. ..... 439/265

(58) Field of Classification Search ..... 439/259, 439/261, 265

See application file for complete search history.

(56) References Cited

U.S. PATENT DOCUMENTS

| | | | | |
|---|---|---|---|---|
| 1,119,864 | A * | 12/1914 | Ovington | 439/269.2 |
| 2,476,365 | A * | 7/1949 | Greco | 439/265 |
| 3,643,202 | A * | 2/1972 | Coon | 439/263 |
| 3,902,075 | A * | 8/1975 | Oros | 307/10.5 |
| 5,033,974 | A * | 7/1991 | Biederstedt et al. | 439/265 |
| 6,676,428 | B2 * | 1/2004 | Burton | 439/270 |
| 7,175,463 | B2 | 2/2007 | Burton | |

FOREIGN PATENT DOCUMENTS

| | | |
|---|---|---|
| GB | 398541 | 9/1933 |
| WO | W02007106739 | 9/2007 |

* cited by examiner

*Primary Examiner* — Phuong K Dinh
(74) *Attorney, Agent, or Firm* — Fletcher Yoder

(57) ABSTRACT

An aircraft electrical connector is provided with features to allow facile engagement with an aircraft and strong retention forces. The aircraft electrical system may include the aircraft electrical connector having a unique biasing mechanism and modular construction, wherein the biasing mechanism is configured to place differential forces onto mating electrical connectors from an aircraft. The biasing mechanism may be operatively coupled to a handle or trigger, which may be easily engageable by an operator. In one embodiment, an electrical connector may include a cam plate disposed between electrical connectors. The cam plate is configured to place differential forces on mating connectors inserted into the electrical connectors. In another embodiment, an electrical connector includes a moveable shaft that is disposed between electrical connectors. The shaft is configured to bias the position of the electrical connectors to place differential engagement and retention forces on mating connectors inserted into the electrical connectors.

19 Claims, 13 Drawing Sheets

AIRCRAFT ELECTRICAL CONNECTOR WITH DIFFERENTIAL ENGAGEMENT AND OPERATIONAL RETENTION FORCES

CROSS REFERENCE TO RELATED APPLICATIONS

This application is a continuation-in-part of U.S. patent application Ser. No. 11/681,674, entitled "Aircraft Power Connector with Differential Engagement and Operational Retention Forces" filed on Mar. 2, 2007, which claims priority to U.S. Provisional Application No. 60/781,842, filed on Mar. 13, 2006, both of which are hereby incorporated by reference in their entirety.

FIELD OF THE INVENTION

The present invention relates generally to aircraft electrical connectors. Specifically, embodiments are disclosed wherein an aircraft power connector has differential engagement and retention forces.

BACKGROUND OF THE INVENTION

This section is intended to introduce the reader to various aspects of art that may be related to various aspects of the present system and techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

When an aircraft (e.g., a military aircraft or a commercial airliner) is being serviced, a stationary power system (e.g., bridge mounted power system), a fixed central power system, or a mobile ground power cart may supply electrical power necessary for basic operations while the aircraft's engines are not being used to power the aircraft. The power source may include an electrical generator (e.g., diesel or gasoline engine driven generator) or an electrical power grid. Typically, the aircraft is electrically connected to the ground power by way of an electrical connector mating. Existing ground power connectors typically include open orifices through which the connectors on the electrical aircraft are connected. The repeated connection and disconnection associated with connecting the ground power with the aircraft may wear the connectors, effectively limiting the number of connections that may be made between the aircraft and ground power. Furthermore, due to the construction of the connectors, the force needed to connect the ground power with the aircraft is often equal to the force of retention, which may create difficulties in situations where an operator may not be able to exert the requisite amount of force needed for connection and disconnection.

SUMMARY OF THE INVENTION

A system is provided for powering an aircraft while in service. The system may contain, among other features, an aircraft electrical connector containing a first electrical connector, a trigger configured to move the first electrical connector between a first position having a first retention force and a second position having a second retention force. The second retention force may be lower than the first so as to allow an operator to easily connect and disconnect the connector from the aircraft.

A system is provided containing an aircraft electrical connector including a first electrical connector and a biasing mechanism configured to move the first electrical connector in a first direction crosswise relative to a connection axis of the aircraft electrical connector. A trigger is coupled to the biasing mechanism.

A system is provided containing an aircraft electrical connector which includes, among other features, a first electrical connector configured to couple with a first mating connector, a biasing mechanism configured to move between a first position and a second position, wherein the first position has a first retention force between the first electrical connector and the first mating connector, the second position has a second retention force between the first electrical connector and the first mating connector, and the second retention force is greater than the first retention force. A trigger is coupled to the biasing mechanism.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE ILLUSTRATED EMBODIMENTS

Figure 1:
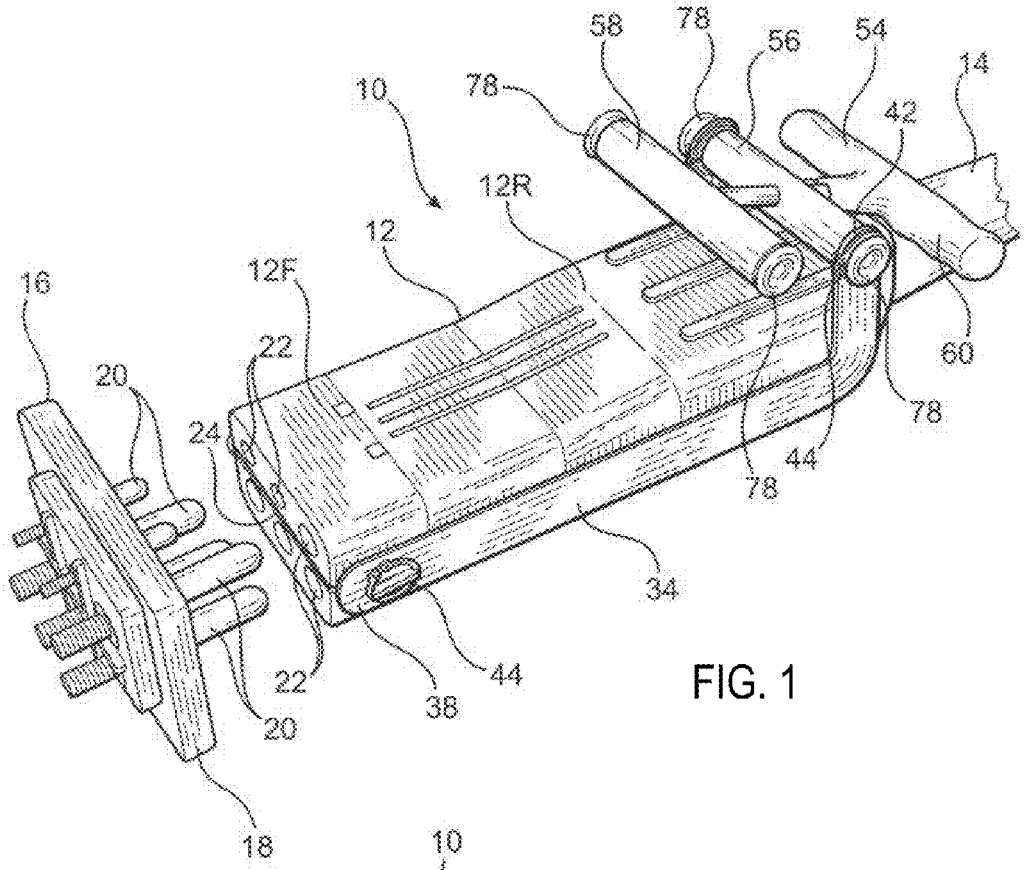
FIG. 1 is a perspective view of an embodiment of an aircraft electrical connector which has been constructed in accordance with present techniques, illustrated as being disposed adjacent to a conventional onboard aircraft electrical connector.
Figure 2:
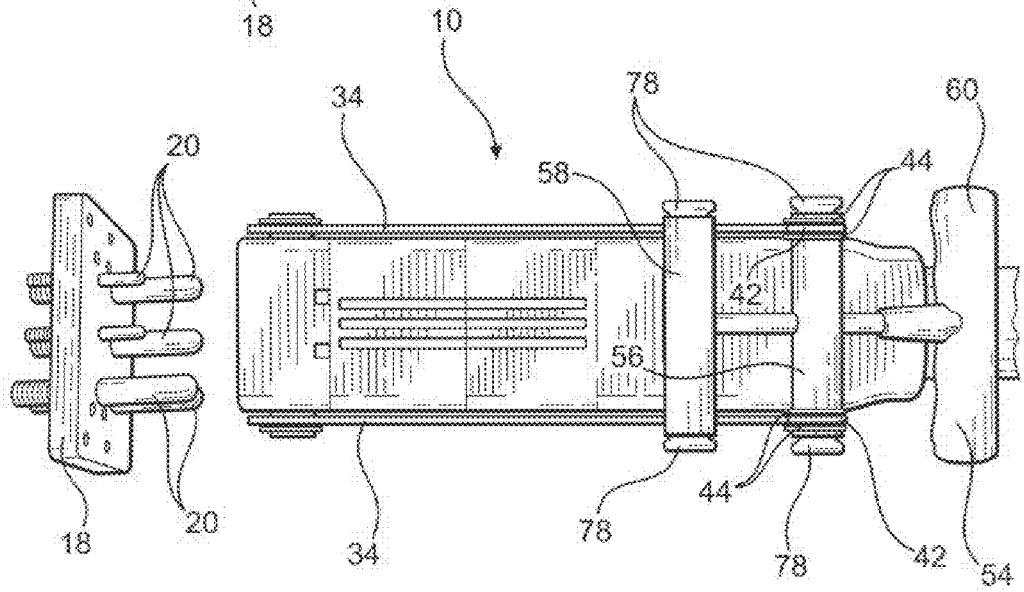
FIG. 2 is a substantially top plan view of the aircraft power connector and onboard aircraft electrical connector illustrated in FIG. 1.

Referring now to the drawings and more particularly to FIGS. 1-5 thereof, an embodiment of an aircraft electrical connector 10 is illustrated. The aircraft electrical connector 10, as illustrated, contains an aircraft electrical connector housing 12, and while the aircraft electrical connector housing 12 is illustrated as comprising a forward housing section 12F and a rearward housing section 12R which has an electrical cable 14 physically and electrically connected thereto, the aircraft electrical connector housing 12 may alternatively be fabricated as a one-piece construction and will effectively be treated as such for the purposes of this disclosure. More particularly, the aircraft electrical connector 10 is adapted to be physically and electrically connected to a conventional or standard onboard aircraft electrical connector 16, which is fixedly mounted at a predetermined location upon an aircraft, so as to provide electrical power to the aircraft when the aircraft is being serviced. The onboard aircraft electrical connector 16 generally contains a mounting plate structure 18 upon which six male electrical connector pins 20 are fixedly mounted so as to project outwardly therefrom. In accordance with FCC regulations and guidelines, six male electrical connector pins 20 are arranged within two rows with each one of the two rows containing three male electrical connector pins 20. Correspondingly, it is seen that the forward end portion of the aircraft electrical connector housing 12 is provided with six bores 22 within which six electrical connector pins, not visible in the drawings, are fixedly mounted. As with the onboard aircraft electrical connector 16, the six bores 22 and six electrical connector pins are arranged within two rows with each one of the two rows containing three electrical connector pins. In one embodiment, the forward end portions of the six electrical connector pins that are disposed within the aircraft electrical connector housing 12 are female receptacles, and in this manner, the aircraft electrical connector 10 is able to be physically and electrically mated with the onboard aircraft electrical connector 16.

It is noted that, when a conventional aircraft electrical connector is to be electrically connected to the onboard aircraft electrical connector 16, the retention force is intentionally designed to be sufficiently large and relatively high, such as, for example, to be within the range of 80 lb±20 lb. Such a retention force may ensure that the integrity of the electrical connection will not be inadvertently adversely interrupted or otherwise compromised throughout the time when the aircraft is being serviced. This retention force is a function of, for example, the friction or interference fit defined between the external or outside diameter dimensions of the male electrical connector contact pins 20 disposed upon the onboard aircraft electrical connector 16 and the internal or inner diameter dimensions of the female receptacle portions of the electrical connector contact pins disposed within the conventional aircraft connector.

However, it is additionally noted that in embodiments where the retention force is sufficiently large or relatively high, the insertion force that is required to initially establish the electrical connection between the conventional aircraft electrical connector and the onboard aircraft electrical connector 16 be large or relatively high. As has been noted hereinbefore, such a relatively large or high insertion force level will sometimes present procedural problems or difficulties for operational personnel in connection with the establishment of the electrical connection between the conventional aircraft connector and the onboard aircraft electrical connector 16.

In accordance with an aspect of the present techniques, the internal or inner diameter dimensions of the female receptacle portions of the electrical connector contact pins disposed within the aircraft electrical connector housing 12 are enlarged to a predetermined degree, such as, for example, one thousandth of an inch (0.001") with respect to the external or outside diameter dimensions of the male electrical connector contact pins 20 disposed upon the onboard aircraft electrical connector 16. In this manner, the insertion force which is required to initially mate the aircraft connector 10 with the onboard aircraft electrical connector 16, and which is a function of, for example, the friction or interference fit, is able to be substantially reduced to a more manageable level, such as, for example, within the range of about 20 lb±5 lb, or about 15 lb±10 lb.

While the insertion force level characteristic of the aircraft electrical connector 10 has effectively been reduced, sufficient to assuredly retain the aircraft electrical connector 10 and the onboard aircraft electrical connector 16 physically and electrically connected to each other. Therefore, additional retention force may be provided upon the aircraft connector 10 in order to effectively raise or enhance the force level, such that subsequent to the physical and electrical connection together of the aircraft connector 10 with the onboard aircraft electrical connector 16 will assuredly be retained.

Figure 9:
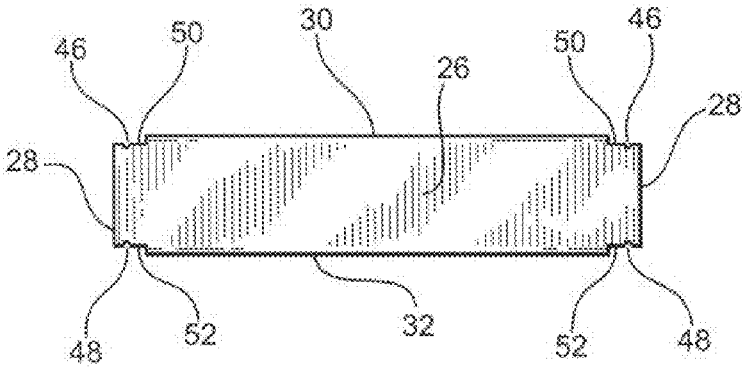
FIG. 9 is a top plan view of the force-transmission cam plate member of an embodiment of the unique biasing mechanism of the aircraft electrical connector.
Figure 10:
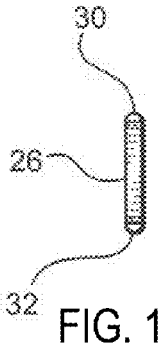
FIG. 10 is an end elevational view of the force-transmission cam plate member as illustrated within FIG. 9.

With reference therefore now being made to FIGS. 1-5, it is initially noted that the aircraft electrical connector housing 12 fabricated from a suitable rubber-type material such as, for example, neoprene rubber, polyurethane, or the like. In FIG. 1, a transversely or laterally extending slot 24 is formed within the forward end portion of the aircraft electrical connector housing 12 so as to extend rearwardly a predetermined distance from the front face of the aircraft electrical connector housing 12. The slot 24 is also seen to be formed between the upper and lower rows of electrical connector bores 22 defined within the forward end portion of the aircraft connector housing 12, and in this manner, the forward end portion of the aircraft connector housing 12 is effectively divided into upper and lower half portions. A force-transmission cam plate member 26, as can best be seen and appreciated from FIGS. 9 and 10, is adapted to be inserted into the slot 24 such that the oppositely disposed end portions 28 of the force-transmission cam plate member 26 project laterally outwardly from the oppositely side wall portions of the aircraft connector housing 12. In FIG. 10, it is additionally seen that the longitudinally spaced edge portions 30, 32 of the force-transmission cam plate member 26 have rounded or arcuate configurations so as not to abrade the rubber-type material from which the aircraft connector housing 12 is fabricated when the force-transmission cam plate member 26 is rotated.

Figure 7:
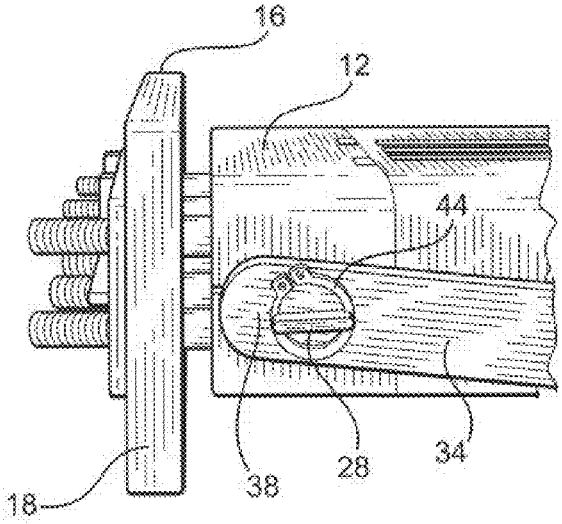
FIG. 7 is an enlarged, partial, substantially side elevational view of the aircraft electrical connector of FIG. 3, illustrating the connection of a first end portion of one of the lever arms of the biasing member of the aircraft electrical connector of FIG. 1, illustrated as mounted upon one end of a force-transmission cam plate member, which projects outwardly through a side wall portion of the aircraft electrical connector housing, by means of a retaining ring or snap-ring member.
Figure 8:
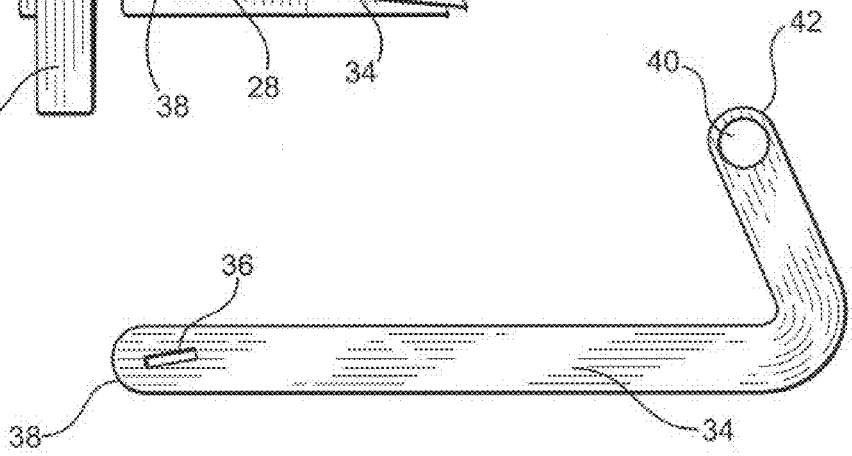
FIG. 8 is a side elevational view of one of the substantially L-shaped lever members of one embodiment of the unique biasing mechanism of the aircraft electrical connector.
Figure 11:
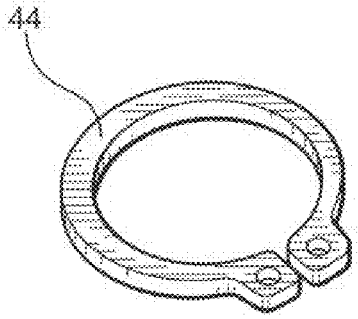
FIG. 11 is a perspective view of a retaining ring or snap-ring member used to secure together component parts of an embodiment of the unique biasing mechanism of the aircraft electrical connector.

In order to actuate or rotatably move the force-transmission cam plate member 26 between its first and second limit positions, a pair of lever members 34, 34, each one of which has a substantially L-shaped configuration, is operatively connected to the oppositely disposed end portions 28, 28 of the force-transmission cam plate member 26. More particularly, as shown in FIG. 8, each one of the lever members 34 has a through-slot 36 defined within a first end portion 38 thereof, while a through-bore 40 is defined within a second opposite end portion 42 of each lever member 34. The oppositely disposed end portions 28, 28 of the force-transmission cam plate member 26 are adapted to be respectively inserted through the slots 36, 36 that are defined within the first end portions 38, 38 of the oppositely disposed lever members 34, 34 to secure the first end portions 38, 38 upon the oppositely disposed end portions 28, 28 of the force-transmission cam plate member 26. A pair of retaining rings, snap-rings, or spring-clips 44, 44 (as shown in FIGS. 7 and 11) are adapted to be mounted upon the oppositely disposed end portions 28, 28. More particularly, as shown in FIG. 9, each one of the oppositely disposed end portions 28, 28 of the force-transmission cam plate member 26 has a pair of grooves or recesses 46, 48 respectively defined within the longitudinally spaced edge portions 50, 52 thereof. Accordingly, after the oppositely disposed end portions 28, 28 of the force-transmission cam plate member 26 are respectively inserted through the slots 36, 36 of the lever members 34, 34, and when the snap-rings, retaining rings, or spring-clips 44, 44 are respectively snap-fitted over the oppositely disposed end portions 28, 28, the retaining rings, snap-rings, or spring clips 44, 44 will effectively securely mount the first end portions 38, 38 of the lever members 34, 34 onto the oppositely disposed end portions 28, 28 of the force-transmission cam plate member 26 as shown in FIG. 7.

Continuing further, in order to actuate or rotatably move the pair of lever members 34, 34, an actuating handle assembly is operatively associated with the second end portions 42, 42 of the lever members 34, 34. More particularly, the actuating handle assembly may be a handle 54 having a substantially T-shaped configuration, a rotary member 56 rotatably mounted, around its longitudinal axis, through means of its oppositely disposed end portions being disposed within the through-bores 40, 40 defined within the second opposite end portions 42, 42 of the oppositely disposed lever members 34, 34, and a secondary cam member 58 fixedly mounted upon the distal end of the handle 54. In one embodiment, the handle 54 may contain a transversely oriented finger or hand-grasping portion 60, and a shaft portion 62 which is adjustably mounted within the rotary member 56. The shaft portion 62 may be fabricated, for example, from a structural member having a hexagonal cross-sectional configuration (e.g., an Allen wrench). Additionally, the upper end portion of the shaft member can be bent 90° in a first direction and then bent again, in effect back upon itself 180° in the opposite direction, so as to effectively form an integrally connected transversely oriented structural member that forms the internal cross-member of the hand-grasping portion 60. A suitable thermoplastic material may then be molded over the upper end portion of the shaft member and the cross-member so as to form the hand-grasping portion 60.

Figure 6:
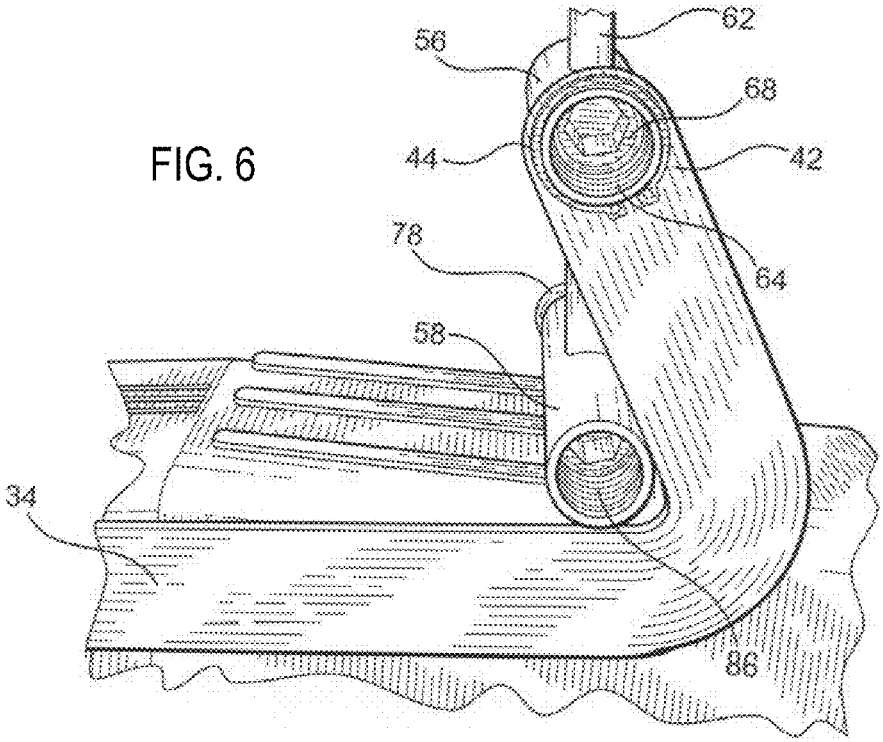
FIG. 6 is an enlarged, partial, substantially side elevational view of the aircraft electrical connector of FIG. 5, illustrating an embodiment of a portion of an embodiment of a biasing member in accordance with an aspect of the present techniques.
Figure 16:
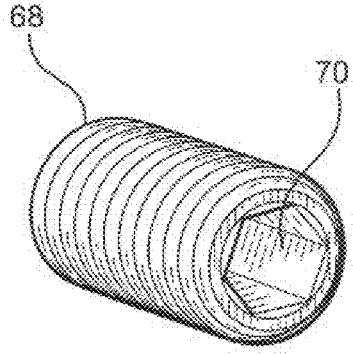
FIG. 16 is rear perspective view of a set screw member which may be used within either one of the rotary tubular member or the secondary cam member as illustrated within FIGS. 12 and 13, or FIGS. 14 and 15, respectively.
Figure 17:
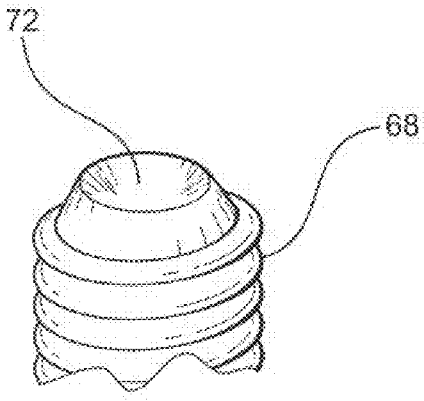
FIG. 17 is a perspective view of the forward end portion of the set screw as illustrated within FIG. 16.
Figure 12:
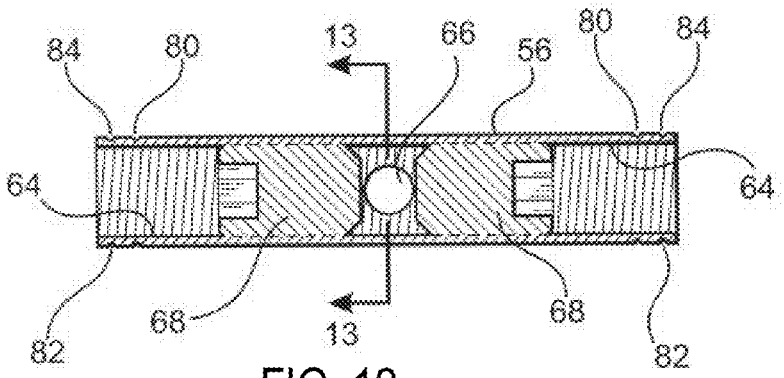
FIG. 12 is a longitudinal cross-sectional view of the rotary tubular member of an embodiment of the unique biasing mechanism of the aircraft electrical connector illustrated in FIG. 1.
Figure 13:
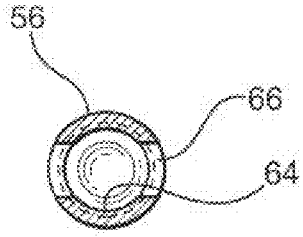
FIG. 13 is a cross-sectional view of the rotary tubular member as illustrated within FIG. 12 as taken along the lines 13-13 of FIG. 12.

With reference being made to FIGS. 6, 12, and 13, it is seen that the rotary member 56 may contain a hollow tubular member wherein, for example, the inner periphery thereof is internally threaded throughout its entire longitudinal or axial extent. In some embodiments, a through-bore 66 is defined within the central region of the rotary member 56 so as to permit a central portion of the shaft portion 62 of the handle 54 to pass therethrough. A pair of externally threaded set screws 68, 68 (illustrated in FIGS. 16 and 17) are adapted to be threadedly engaged within the oppositely disposed ends of the internally threaded rotary member 56 so as to engage the shaft portion 62 of the handle 54, and thereby fixedly secure the shaft portion 62 of the handle 54 at a particular position within the rotary member 56. As can best be additionally seen and appreciated from FIGS. 16 and 17, the rear end portion of each set screw 68 has a hexagonally configured recess 70 formed therewithin so as to permit a suitable rotary driving tool, such as, for example, an Allen wrench, to be drivingly engaged with the set screw 68 in order to threadedly mount the same within one end portion of the internally threaded bore 64 of the rotary member 56. In addition, the forward end portion of each set screw 68 is provided with a cup-shaped recess 72 such that the forwardmost point of each set screw 68 defines a linear locus having a circular or annular configuration as opposed to a solid circular surface or face. This structure enables each set screw 68 to more effectively grip one of the planar surfaces containing the hexagonally configured shaft portion 62 of the handle 54 when the set screw 68 is in fact engaged with the shaft portion 62 of the handle 54

Figure 18:
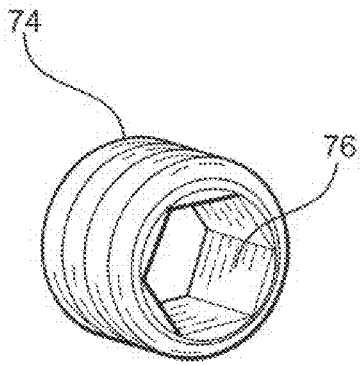
FIG. 18 is a perspective view of a jam-nut member which may be utilized in conjunction with any one of the set screw members as illustrated within FIGS. 16 and 17.
Figure 19:
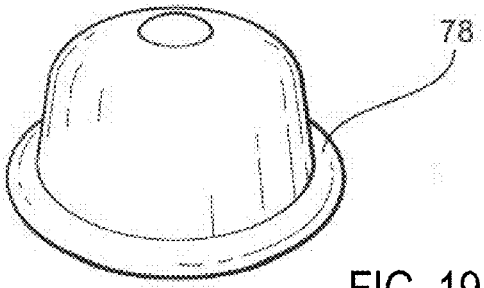
FIG. 19 is a perspective view of a plug member which may be utilized within either one of the rotary tubular member or the secondary cam member as illustrated within FIGS. 12 and 13, or FIGS. 14 and 15, respectively.

Still further, in order to fixedly secure each one of the set screws 68 at its engaged position with the shaft portion 62 of the handle 54, an externally threaded jam nut or jam set screw 74, as illustrated within FIG. 18, may likewise be threadedly engaged within each one of the oppositely disposed end portions of the internally threaded bore 64 of the rotary member 56 until each one of the jam nuts or jam set screws 74, 74 tightly engages a respective one of the set screws 68, 68. In a manner similar to that of each one of the set screws 68, each one of the jam nuts or jam set screws 74, 74 has a hexagonally configured through-bore 76 defined therethrough so as to permit a suitable rotary driving tool, such as, for example, an Allen wrench, to be drivingly engaged with the jam nut or jam set screw 74 in order to respectively threadedly mount the same within one end portion of the internally threaded bore 64 of the rotary member 56. With reference also being made to FIGS. 1-5 and 19, it is additionally seen that end plugs 78, 78, fabricated, for example, from a suitable thermoplastic material, may be respectively inserted, in accordance with a friction or snap-fitting mode of operation, into each open end of the internally threaded bore 64 of the rotary member 56 so as to simply provide the opposite ends of the rotary member 56 with a finished appearance as well as to prevent dirt, debris, contaminants, or the like, from entering such open ends of the internally threaded bore 64.

With reference being made to FIGS. 1-6, 8, and 12, in order to respectively rotatably secure the oppositely disposed end portions of the rotary member 56 within the second end portions 42, 42 of the lever members 34, 34, and concomitantly or conversely, in order to respectively positionally secure the second end portions 42, 42 of the lever members 34, 34 onto the oppositely disposed end portions of the rotary member 56, it is seen, as illustrated in FIG. 12, that the external peripheral surface regions of each one of the oppositely disposed end portions of the rotary member 56 are provided with a pair of longitudinally or axially spaced annular recesses or grooves 80, 82 with a non-recessed or non-grooved region 84 defined therebetween. Accordingly, when, for example, the second end portions 42, 42 of the lever members 34, 34 are to be respectively mounted onto the end portions of the rotary member 56, a first retaining ring, snap-ring, or spring clip 44, is initially mounted within each one of the axially inner annular grooves or recesses 80, 80. The end portions of the rotary member 56 are then respectively inserted through the through-bores 40, 40 such that the inner peripheral surface regions of the through-bores 40, 40 will respectively effectively be seated upon the external peripheral, non-recessed or non-grooved regions 84, 84 of the oppositely disposed end portions of the rotary member 56. Lastly, a second retaining ring, snap-ring, or spring clip 44 is mounted within each one of the axially outer annular grooves or recesses 82, 82, thereby effectively positionally trapping each one of the second end portions 42, 42 of the lever members 34, 34 upon the end portions of the rotary member 56. These assemblies are illustrated within, for example, FIGS. 1-4 and 6.

Figure 14:
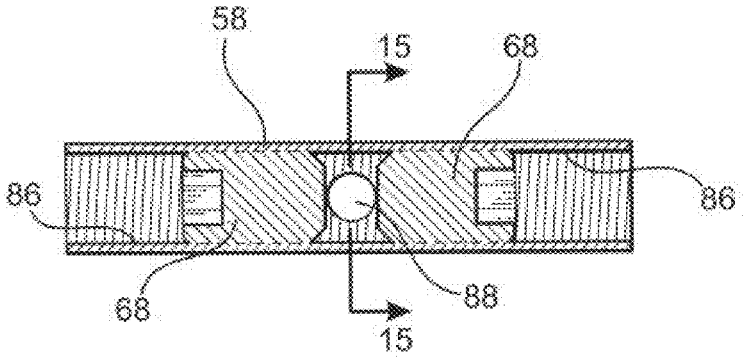
FIG. 14 is a longitudinal cross-sectional view of the secondary cam member of the unique biasing mechanism of the aircraft electrical connector illustrated in FIG. 1.
Figure 15:
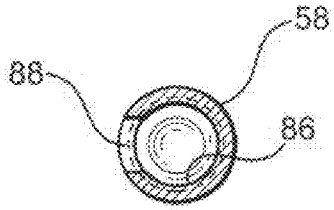
FIG. 15 is a cross-sectional view of the secondary cam member as illustrated within FIG. 14 as taken along the lines 15-15 of FIG. 14.

In FIGS. 14 and 15, it is seen that the secondary cam member 58 is structurally similar to the rotary member 56 in that the secondary cam member 58 likewise contains a hollow tubular member wherein, for example, the inner periphery thereof is internally threaded throughout the entire longitudinal or axial extent thereof. In one particular embodiment, a blind bore 88 is formed within one centrally located side wall portion of the secondary cam member 58 so as to permit the distal end portion of the shaft portion 62 to be inserted into the blind bore 88 and effectively be seated upon the oppositely disposed internal side wall portion of the secondary cam member 58. Subsequently, in order to fixedly secure the distal end portion of the shaft portion 62 within the secondary cam member 58, a pair of externally threaded set screws 68, 68 is adapted to be threadedly engaged within the oppositely disposed ends of the internally threaded secondary cam member 58.

Still further, in order to fixedly secure each one of the set screws 68 at its engaged position with the distal end portion of the shaft portion 62 of the handle 54, an externally threaded jam nut or jam set screw 74 may be threadedly engaged within each one of the end portions of the internally threaded bore 86 of the secondary cam member 58 until each one of the jam nuts or jam set screws 74, 74 tightly engages a respective one of the set screws 68, 68. End plugs, similar to the end plugs 78, 78, as illustrated within FIG. 19, may be respectively inserted into each open end of the internally threaded bore 86 of the secondary cam member 58 so as to simply provide the opposite ends of the secondary cam member 58 with a finished appearance as well as to prevent dirt, debris, contaminants, or the like, from entering such open ends of the internally threaded bore 86.

Having described the various structural components according to one embodiment of the aircraft electrical connector 10, a method of operation of using the same will now be described. More particularly, when the actuating handle assembly is disposed at the position illustrated within any one of FIGS. 1-3 whereby handle 54 has effectively been rotated in the clockwise direction, the aircraft electrical connector 10 may be disposed at its UNLOCKED position such that the secondary cam member 58 is disengaged from, or disposed out of contact with, the aircraft electrical connector housing 12. Thus, the female receptacle portions of the electrical connector contact pins disposed within the aircraft electrical connector housing 12 may exhibit a relatively low insertion or engagement force level on the order of, for example, about 15 lb±10 lb due to the foregoing enlarged machining of the female receptacle portions of the electrical connector contact pins disposed within the aircraft electrical connector housing 12. Accordingly, at this point in time, the aircraft electrical connector 10 can be moved by operator personnel from its disengaged position with respect to the onboard electrical connector 16, as illustrated within FIGS. 1 and 2, to its position illustrated within FIG. 3 at which the aircraft electrical connector 10 is able to be readily and easily physically mated or engaged with, and electrically connected to, the onboard aircraft electrical connector 16 in a coaxially aligned manner.

Subsequently, when it is desired to increase the force level defined between the aircraft electrical connector housing 12 and the onboard aircraft electrical connector 16, the handle 54 is rotated in the counterclockwise direction around the rotary axis defined by means of the rotary member 56, such that the secondary cam member 58 is initially moved from its disposition illustrated in FIG. 3 to an intermediate position, as illustrated within FIG. 4, wherein the secondary cam member 58 is now disposed in contact with the upper surface portion of the aircraft electrical connector housing 12. Subsequently, continued rotation of the handle 54 in the counterclockwise direction from its intermediate position, as illustrated within FIG. 4, to its final or LOCKED position, as illustrated within FIG. 5, causes the pair of lever members 34, 34 to undergo rotational or pivotal movement in the counterclockwise direction wherein the pair of lever members 34, 34 will, in turn, cause the force transmission cam plate member 26 to rotate or pivot around its longitudinal axis.

As mentioned, the force transmission cam plate member 26 may be disposed within the slot 24 of the aircraft electrical connector housing 12, such that the aforenoted rotational or pivotal movement of the force transmission cam plate member 26 will effectively cause the lower half of the forward end portion of the aircraft electrical connector housing 12, and the female receptacle portions of the electrical connector contact pins disposed within, to move downwardly a predetermined amount. This predetermined downward movement of the lower row of female receptacle portions of the electrical connector contact pins may effectively cause a predetermined amount of coaxial misalignment to be developed between the lower row of female receptacle portions of the electrical connector contact pins and the lower row of male electrical connector contact pins 20 mounted upon the onboard aircraft electrical connector 16. Accordingly, such a predetermined amount of coaxial misalignment may result in enhanced or increased surface-to-surface and frictional contact. In turn, such enhanced or increased surface-to-surface and frictional contact results in enhanced or increased retention engagement forces to be developed between the lower row of female receptacle portions of the electrical connector contact pins and the lower row of male electrical connector contact pins 20. Accordingly, the associated disengagement resistance forces may likewise be enhanced.

Figure 5:
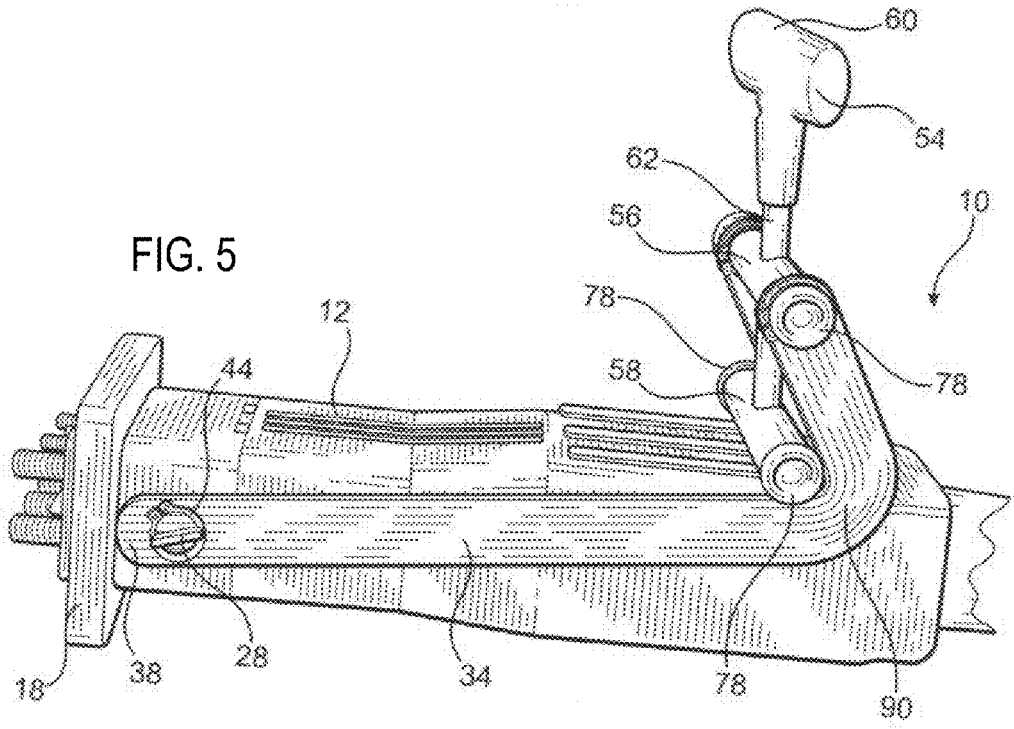
FIG. 5 is a substantially side elevational view of the aircraft electrical connector of FIG. 3, illustrating one embodiment of the unique biasing mechanism in a locked position.

It is to be further noted that the actuating handle assembly, containing the handle 54, the rotary member 56, and the secondary cam member 58, effectively displays an over-center locking mechanism whereby when the handle 54 is rotated in the counterclockwise direction to its fully LOCKED position, as illustrated within FIG. 5. As such, the secondary cam member 58 will be moved slightly beyond the vertical plane within which the rotary axis, defined by means of the rotary member 56, is located so as to effectively snap into its LOCKED position which is located at the juncture 90. It is noted still yet further that the disposition of the handle 54 with respect to the rotary member 56 can be readily adjusted by effectively altering the particular axial location, as taken along the shaft portion 62 of the handle 54. Altering the disposition of the handle 54 with respect to the rotary member 56 of course alters the distance or moment arm defined between the secondary cam member 58 and the rotary member 56 so as to, in turn, alter the position at which the secondary cam member 58 will in effect encounter the upper surface portion of the aircraft electrical connector housing 12. Such an altered state or position will in turn alter the degree to which the lever members 34, 34, and the attached force transmission cam plate member 26, are rotated or pivoted before the secondary cam member 58 attains its final or LOCKED position. Accordingly, the degree to which the lower row of female receptacle portions of the electrical connector contact pins and the lower row of male electrical connector contact pins 20 are disposed in frictional contact with respect to each other can be predeterminedly adjusted.

Figure 3:
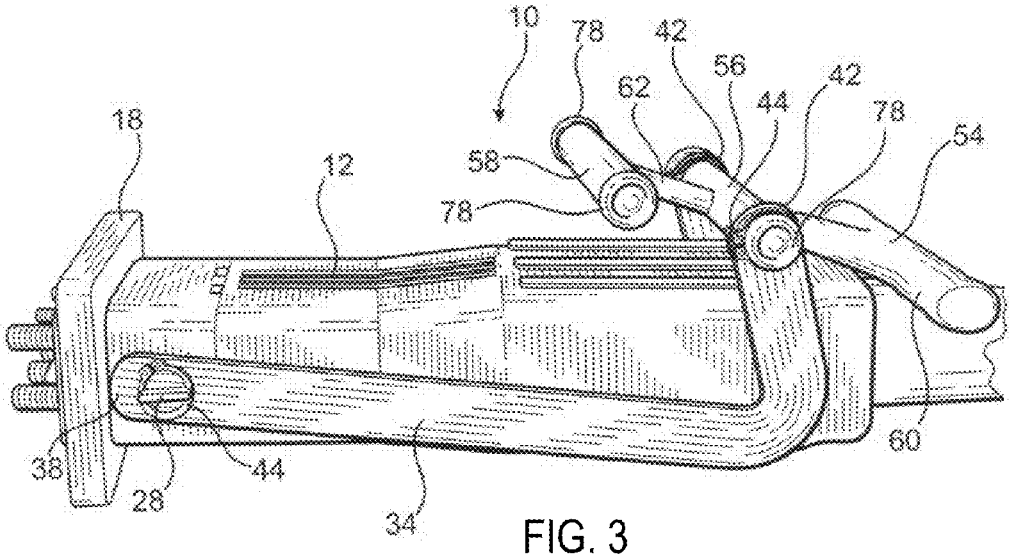
FIG. 3 is a substantially side elevational view of the aircraft electrical connector and the onboard aircraft electrical connector illustrated within FIG. 1, wherein the two are illustrated as being electrically connected.
Figure 4:
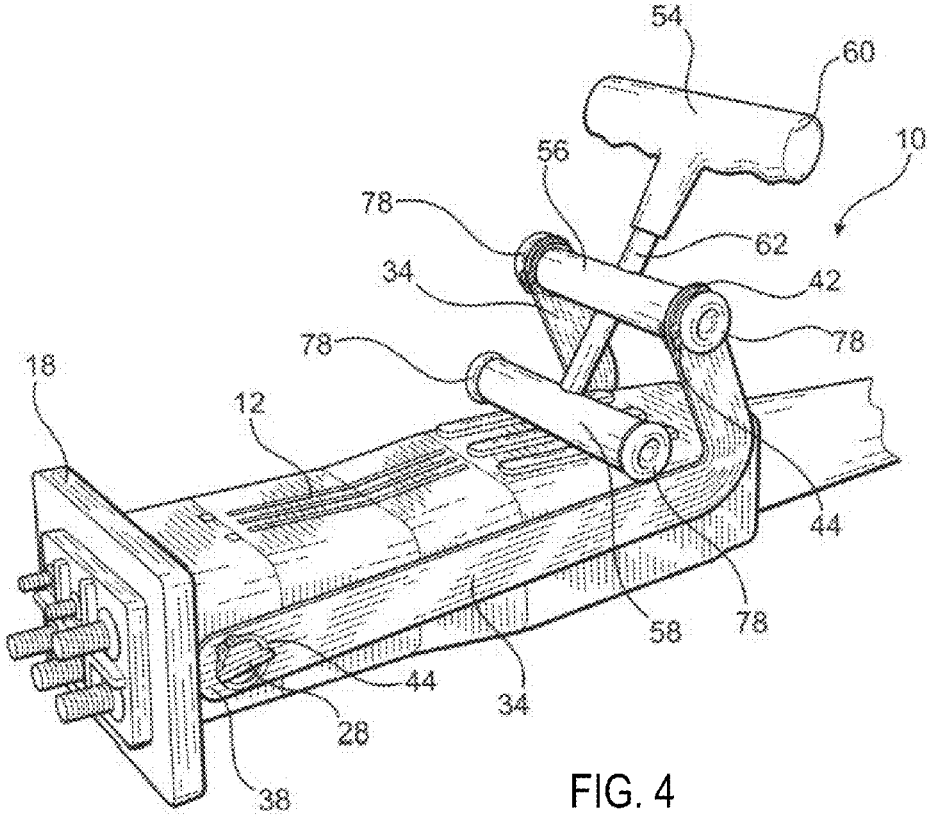
FIG. 4 is a perspective view of the aircraft electrical connector and onboard aircraft electrical connector of FIG. 2, illustrated in an engaged position.

It may be appreciated that when the aircraft electrical connector 10 is to be intentionally disconnected from the onboard aircraft electrical connector 16, such as, for example, when servicing of the aircraft has been terminated, the handle 54 is rotated in the reverse, clockwise direction from its position illustrated within FIG. 5 toward its position illustrated, for example, within FIG. 3. This may free or release the secondary cam member 58 from its locked position and moving the same to its released position as illustrated, for example, within FIG. 3. This permits the lever members 34, 34, and the operatively connected force transmission cam plate member 26, to be rotatably or pivotally moved in the clockwise direction so as to effectively relieve or reduce the force level, defined between the lower row of female receptacle portions of the electrical connector contact pins, disposed and the lower row of male electrical connector contact pins, back to its normal predetermined level of 20 lb±5 lb. The aircraft electrical connector 10 may then be easily and readily disconnected from the onboard aircraft electrical connector 16.

Figure 20:
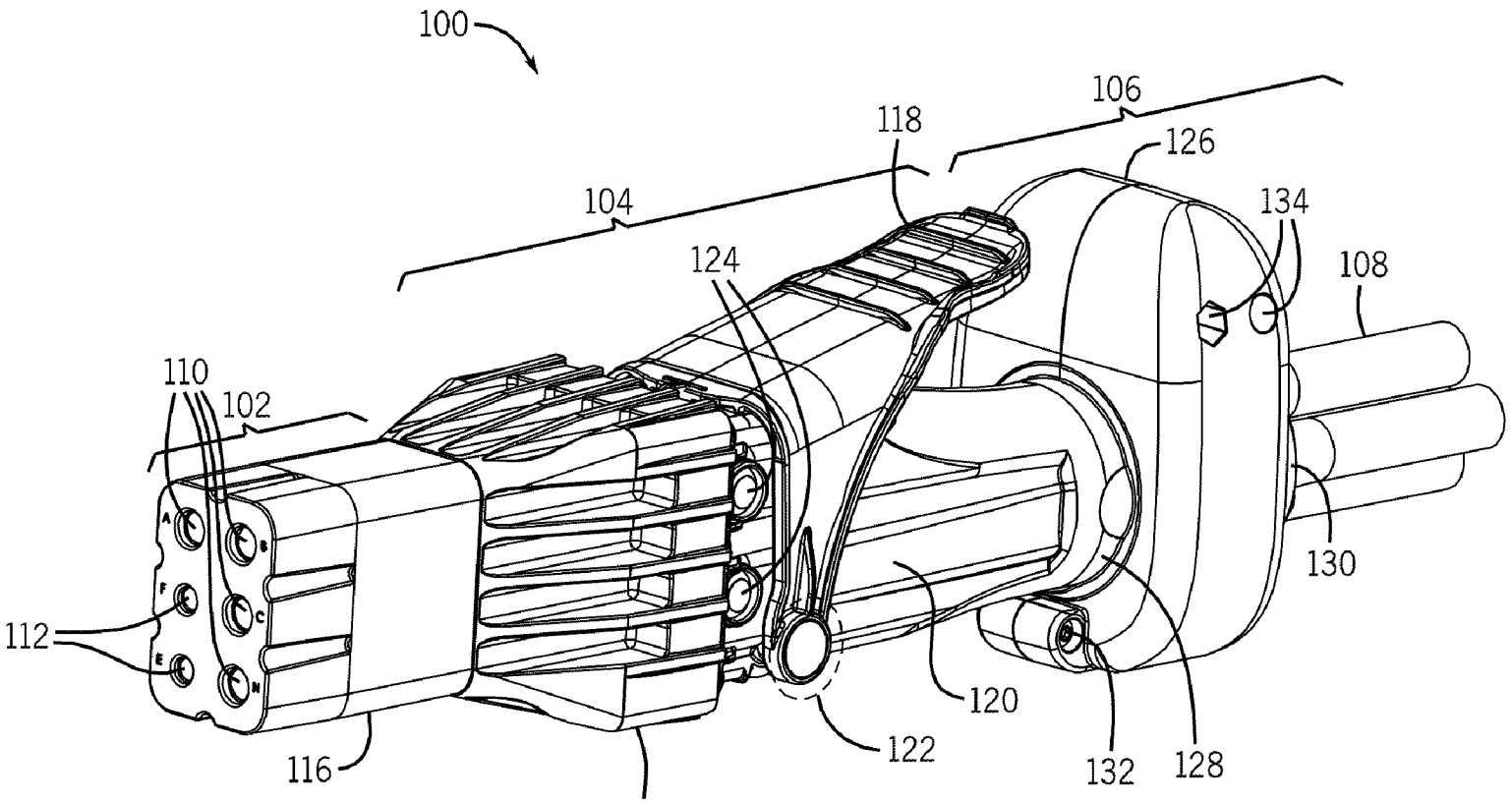
FIG. 20 is a perspective view of an embodiment of an aircraft electrical connector displaying certain features of the unique biasing system according to the present techniques.

Referring now to FIG. 20, one embodiment of an aircraft electrical connector 100 is illustrated depicting an implementation of a unique biasing feature. Among other features, the aircraft electrical connector 100 generally includes a nose assembly 102, a biasing assembly 104, and a cable assembly 106. The cable assembly 106 may be configured to secure one or more cables 108 to the connector 100. The cables 108 may extend through the connector 100, such that the cable passes through the biasing assembly 104 and meets a set of large electrical connectors 110 (e.g., connector sockets) and small electrical connectors 112 (e.g., connector sockets) at an interface housing 114 contained within the biasing assembly 104. In the depicted embodiment, the nose assembly 102 is disposed at a forward section of the connector 100 to facilitate interfacing with an aircraft, and contains the electrical connectors 110, 112 defined within a replaceable nose 116. As with the previous aircraft electrical connector 12, the electrical connectors 110, 112 are configured to removably interface with a mating connection on an aircraft. For example, in the depicted embodiment, the electrical connectors 110, 112 are female connectors configured to axially receive the male connectors 20 (e.g., pins) from an onboard aircraft electrical connector 16. As may be appreciated, the aircraft electrical connector 100 (and thus the nose assembly 102) may be subjected to a number of connections and disconnections within a short period of time as a result of a large number of commercial flights (for example, at a commercial airport). Due to the repeated abutment of the forward portion of the connector 100 with the aircrafts, the replaceable nose 116 may be worn after a relatively short period of time. Thus, it may be desirable to construct the replaceable nose 112 from a robust polymeric material (e.g., impact-resistant polymeric materials) that is configured to be removably secured to the rest of the aircraft electrical connector 100 to allow an operator to replace the nose 116 as often as needed.

In certain embodiments, the nose assembly 102 may be disposed proximate the biasing assembly 104, which may facilitate the biasing of the female electrical connectors 110, 112. As discussed in detail below, the biasing assembly 104 may actuate crosswise movement of one or more female electrical connectors 110, 112 to create a lateral retention force after connection with the male connectors 20. As illustrated, the biasing assembly 104 contains a handle 118 pivotally secured to a housing 120 by way of a pivot joint 122. The housing 120, in some embodiments, may be in mechanical communication with the nose assembly 102 by way of the interface housing 114. For example, the handle 118, when triggered, may engage a portion of the biasing assembly movably extending through the interface housing 114. Such engagement may result in a subtle movement (e.g., crosswise) of one or more of the electrical connectors 110, 112, which may either facilitate or prevent sliding of the electrical connectors 110, 112 over the male connectors of an aircraft, and may depend on a given implementation-specific configuration. As illustrated, the biasing assembly 104 may also contain features (e.g., electrical circuitry) configured to alert an operator as to the status of connectivity between the aircraft electrical connector 100 and the onboard aircraft electrical connector 16. In one embodiment, the circuitry may be a simple switch configured to visually represent the current status of the connector 100, for example, by illumination of a green or red light 124.

To prevent inadvertent triggering of the biasing assembly 104 and to protect the handle 118 from accidental breakage, the aircraft electrical connector 100 may also include a handle protector 126. The handle protector 126 may be constructed from a hard, impact-resistant polymeric material such as Kevlar®, polycarbonates, impact resistant polystyrenes, polyurethanes, and the like. Further, the handle protector 126 may have an annular region through which the cables 108 of the cable assembly 106 extend. In certain embodiments, the annular region may contain a cable seal 128 and cable seal flange 130 configured to secure and direct the cables 108 through the aircraft electrical connector 100. It should be noted that the cable seal 128 and the cable flange 130 may have a generally annular shape, and may be adapted to receive cables 108 in specific configurations, so as to secure the cables 108 tightly to prevent inadvertent movement or disconnection. As such, the cable seal 128 and cable flange 130 may be replaceable, such that many different types of cables 108 may be used in conjunction with the aircraft electrical connector 100. To facilitate such modularity, the handle protector 126 may be of a multiple-piece construction, such as a two-piece construction, and may be assembled by fastening two pieces of the handle protector 126 around the cable seal 128 and cable flange 130. The two pieces that form the handle protector 126 may be secured together by any suitable securing mechanism, such as a snap-fit, interference fit, screw, or any mating connection. In the embodiment illustrated in FIG. 20, the two pieces are fastened together with a head cap screw inserted at a bottom receptacle 132 and a top receptacle 134 of the handle protector 126.

Figure 21:
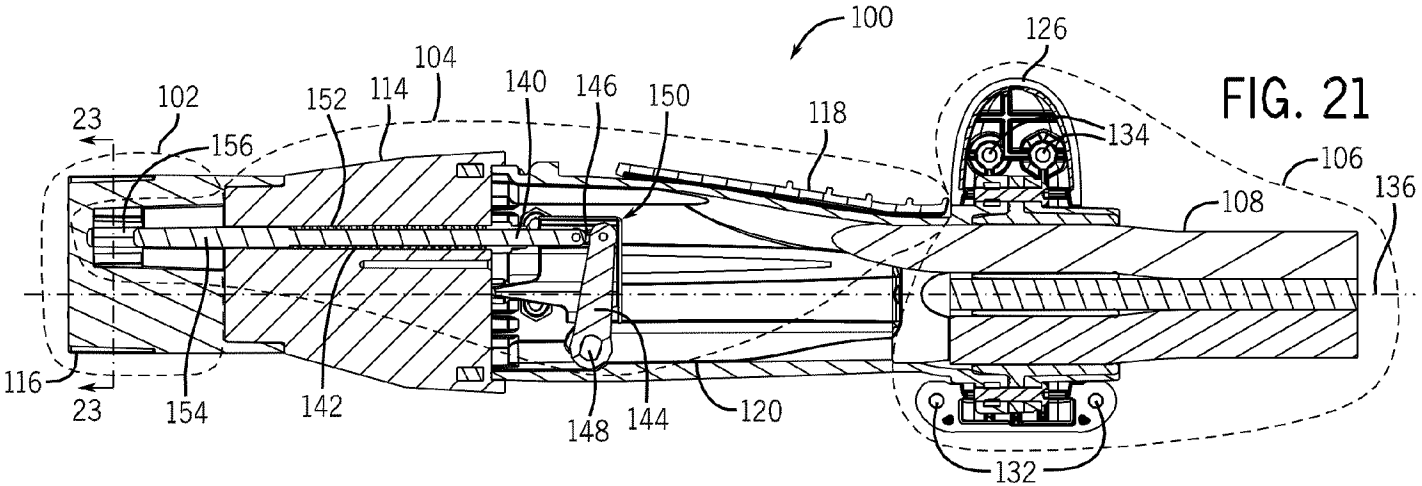
FIG. 21 is a cross-sectional view of the aircraft electrical connector of FIG. 20, taken along an axial plane and displaying features consistent with the unique biasing system of the present techniques and illustrated in a disengaged position.

FIG. 21 is a cross-section taken along a connection axis 136 of the aircraft electrical connector 100, further illustrating certain features of the unique biasing assembly 104 according to one embodiment of the present technique. As depicted, in addition to the interface housing 114, the handle 118, the housing 120, and the pivot joint 122, the biasing assembly 104 also contains features configured to bias the position of the connectors 110, 112. Such features may include a shaft 140, a biasing spring 142, a lever 144, a shaft-lever connection 146, and a cam shaft 148. To protect the cables 108 which extend longitudinally (down the connection axis 136) through the aircraft electrical connector 100, features which are movable may be contained within a cable protector 150, such that the lever 144, the shaft 140, and other moveable parts do not abrade or come into contact with the cables 108.

As depicted, the shaft 140 movably extends through a portion of the housing 120, the interface housing 114, and a portion of the nose assembly 102 along the connection axis 136 of the aircraft electrical connector 100. The biasing spring 142 may be disposed circumferentially around the shaft 140 and may be constrained between one end of the interface housing 114 and a ledge region 152 of the shaft 140, such that the shaft 140 is forwardly biased towards the nose 116. The shaft 140 may be connected to the lever 144 at a pivot point defined by the connection 146. In some embodiments, the connection 146 may be created between the shaft 140 and the lever 144 by a simple chain mechanism, such as a bicycle chain. The lever 144, at one end, is connected to the handle 118 via the cam shaft 148 at the pivot point 122. The cam shaft 148 is configured to convert the movement of the handle 118 (e.g., when the biasing assembly 104 is triggered) into a similar rotational movement of the lever 144. In some embodiments, the cam shaft 148 may be shaped such that the handle 118, which has an engagement area with the cam shaft 148 that is similarly shaped, may allow the direct provision of torque to the cam shaft 148 upon depression of the handle 118, resulting in movement of the lever 144. The movement of the lever 144 results in a concomitant rearwardly motion of the shaft 140 away from the nose 116, resulting in the disengagement of a tapered section 154 of the shaft 140 from one or more collar protrusions 156 which abut some or all of the connectors 110, 112. As such, the shaft 140 may be triggered by the motion of the handle 118, with both the handle 118 and the shaft 140 being biased towards a resting position by the spring 142. Accordingly, the handle 118, the shaft 140, and all other movable components of the biasing assembly 104 may be considered as being movable between a first and second position, the first position corresponding to depression or triggering of the handle 118 and the second position corresponding to releasing the handle 118 and opposite biasing by the spring 142. Indeed, in some embodiments, these positions may be referred to as an open and closed position, respectively, an unlocked and locked position, respectively, or a disengaged and engaged position, respectively. Therefore, the position illustrated in FIG. 21 may be described as a first, open, unlocked, or disengaged position.

Figure 22:
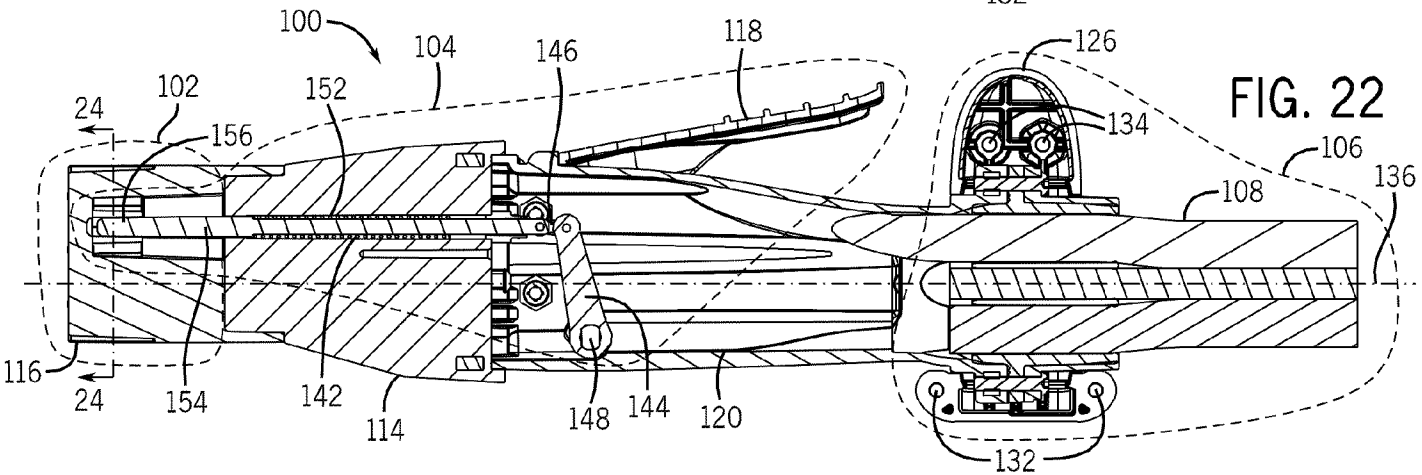
FIG. 22 is a cross-sectional view of the aircraft electrical connector of FIG. 20, taken along an axial plane and displaying features consistent with the unique biasing system of the present techniques and illustrated in an engaged position.

Conversely, FIG. 22 is a depiction illustrating the position of various features within the aircraft electrical connector 100 when the handle 118 has been released. That is, the biasing spring 142 is allowed to release its stored potential energy, returning the shaft 140, the lever 144, the shaft 148, and the handle 118 back to their original, first, closed, locked, or engaged position. Thus, as illustrated, the shaft 140 has traveled forwardly and axially towards the nose 116, allowing engagement of the tapered section 154 of the shaft 140 with the collar protrusions 156, which outwardly bias the positions of some or all of the connectors 110, 112 due to their angle relative to the axis of the shaft 140, as is described further below.

In some embodiments, the biasing spring 142 may be selected to have a specific spring constant, k, such that the force exerted by the spring (the stored potential energy of the compressed spring) is sufficient to move the various components of the biasing assembly 104 (and thus the connectors 110, 112) back to their engaged position. Such springs may be selected based on a desired retention force. For example, a spring with a higher spring constant k may create a larger retention force, as the stored potential energy of the spring 142 results in the biasing of the collar protrusions 156. The travel of the shaft 140, while illustrated as one embodiment displaying a particular length, may be varied as a function of a number of factors, including the number of connectors 110, 112 which may be engaged by the tapered section 154 of the shaft 140, the size of the aircraft electrical connector 100, the relative positions of the components of the biasing assembly 104, and so forth. For example, the shaft 140 may travel only a few millimeters (e.g., between about 1 and about 40 millimeters), or may travel several inches. In other embodiments, the shaft 140 may travel between about 0.5 and about 6 inches (e.g., about 1, 1.5, 2, 3, or 4 inches). Further, the travel of the shaft 140 may be represented as a percentage traveled of the entire length of the aircraft electrical connector 100, and may be between about 0.01 and about 10 percent of the total length of the aircraft electrical connector 100. For example, the travel may be about 0.05, 0.1, 0.2, 0.5, 1, 1.5, 2, 3, 3.5, or 5 percent of the total length of the aircraft electrical connector.

Figure 23:
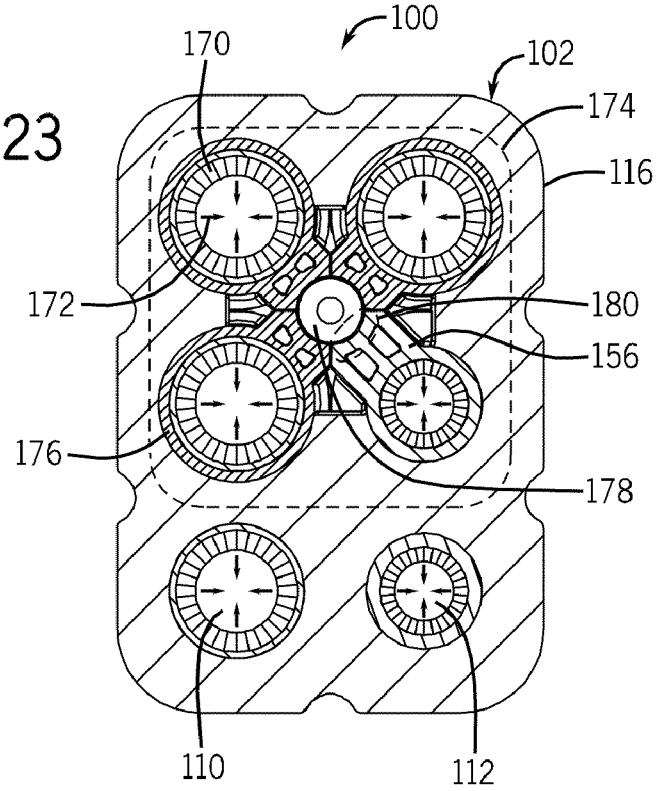
FIG. 23 is a cross-sectional view of the nose assembly of the aircraft electrical connector of FIG. 21, taken along a line 23-23 and illustrated in a disengaged position.

Moving now to FIG. 23, a cross-section of the nose assembly 102 viewed down the connection axis 136 is shown, taken across a line 23-23 from FIG. 21, wherein the aircraft electrical connector is illustrated as being in the unlocked position (trigger 118 depressed). As illustrated, the cross-section of the nose assembly 102 generally includes six receptacles, which, in embodiments where the device is an aircraft electrical connector, correspond to the large electrical connectors 110 and small electrical connectors 112. Each circular opening also includes an annular spring 170 disposed circumferentially within the connectors 110, 112. The annular spring 170, in general, is configured to maintain an electrical connection between the electrical connectors 110, 112 of the aircraft electrical connector 100 and the electrical connectors 20 of the aircraft. According to one aspect, the annular spring 170 is conductive and also exerts a small amount of force on the electrical connectors 20 of the aircraft to stabilize any initial engagement between the connector 100 and the aircraft. In some embodiments, such that the annular spring 170 may efficiently conduct electricity, the annular spring 170 may be a multi-lam rated at between about 10 amps and 30 amps (e.g., 20 amps). In certain of these, each annular spring 170 (multi-lam) may exert a force 172 (the total force exerted by all arrows in a single connector) on a male electrical connector 20 of the aircraft of between about 1 lbs and about 10 lbs. For example, the force exerted may be about 1, 2, 3, 4, 5, 6, 7, 8, 9, or 10 lbs of pressure.

According to an aspect of the present technique, the force exerted by the annular structures 170, in total, may represent the total insertion force necessary to insert the male electrical connectors 20 into the electrical connectors 110, 112 of the aircraft electrical connector 100. Thus, the total insertion force, in certain embodiments, may be between about 6 lbs and about 60 lbs. In one embodiment, the insertion force may be about 15 lbs to about 20 lbs. It is noted that, according to present embodiments, the total insertion force may be much less that what is necessary in conventional aircraft electrical connectors, which may require insertion forces up to 100 lbs. That is, the force needed for insertion may be equal to the force of retention in conventional aircraft electrical connectors, whereas the aircraft electrical connector according to the present embodiments requires a lower insertion force than what is needed or used for retention. In some embodiments, the insertion force may be less than about 20 lbs. For example, in such embodiments, the insertion force may be less than or equal to about 15, 10, 5, or 0 lbs. In other embodiments, the insertion force may be between about 10 percent and 50 percent of the retention force of a conventional aircraft connector. For example, the insertion force may be about 10, 20, 25, 30, 35, 40, 45, or 50 percent of the retention force. In another embodiment, the annular structures 170 may be eliminated. In such an embodiment, the annular structures 170 no longer exert the inward force 172 towards the center of the connectors 110, 112. Of course, if the inward force 172 is eliminated, the aircraft electrical connector 100 will have a substantially zero insertion force.

To allow a decrease in the required insertion force, the connectors 110, 112 may be bored to a slightly larger diameter than what is conventionally used. Surprisingly, by slightly increasing the size of the electrical connectors 110, 112 (e.g., by 0.001 inches), the male connectors 20 of the aircraft may more easily slide into the six openings, avoiding scraping and loss of material, which is a common problem with conventional connectors. Of course, due to such scraping and loss of material, the number of connections that a conventional aircraft electrical connector may be able to perform may be limited to about 50 to about 200 insertions across the life a conventional aircraft electrical connector. In contrast, by enlarging the connectors 110, 112, even to a small extent, the life of the aircraft electrical connector 100 may be, for example, between about 1500 and 2500 (e.g., 2000) insertions. In some embodiments, the longer lifetime of the aircraft electrical connector may be represented as a percentage relative to conventional aircraft electrical connectors. For example, the aircraft electrical connector 100 may have a lifetime, represented by the number of retained insertions, that is between about 300 percent and about fifteen hundred percent greater than that of a conventional aircraft electrical connector (e.g., about 1000 percent greater or about ten times greater).

Further depicted in FIG. 23 is a collar assembly 174. The collar assembly 174 generally includes collars 176, which are disposed circumferentially around one or more of the connectors 110, 112; and the aforementioned collar protrusions 156, which abut with the tapered portion 154 of the shaft 140 during biasing. In some embodiments, the collars 176 are disposed circumferentially about four of the six total electrical connectors 110, 112. Such a configuration may allow biasing of the four of the six connectors 110, 112 from an area 178 disposed substantially centrally between the four of the six electrical connectors 110, 112. The area 178 may be a circular area defined by four quarter-circle end areas 180 of the collar protrusions 156. Generally, the area 178 is where the shaft 140 (more precisely, the shaft taper 154) extends forwardly and axially into the nose assembly 102. Therefore, during operation and when the handle 118 is depressed, the shaft 140 moves rearwardly from the area 178 along the connection axis 136 of the connector 100, causing the collar protrusions 156 to cease to be abutted by the shaft 140 as shown in FIG. 23. Accordingly, the collars 178, collar protrusions 156, end areas 180, and the four biased connectors 110, 112 may move in a radially inward or crosswise direction (e.g., radially converging relationship) relative to the connection axis 136 of the connector 100 to a disengaged position as the shaft taper 154 moves out of the area 118 as shown in FIG. 23. In other words, the trigger 118 is depressed to cause rearward movement of the shaft 140, and the collars 176 and the four connectors 110, 112 move crosswise toward one another in the radially converging relationship. For example, the body of the nose assembly 102 may provide some degree of resiliency, which biases the connectors 110, 112 back to a normal position when the shaft 140 is moved rearward. In this position, the connectors 110, 112 may be spaced similar to the male connectors 20 to enable easy insertion.

Figure 24A:
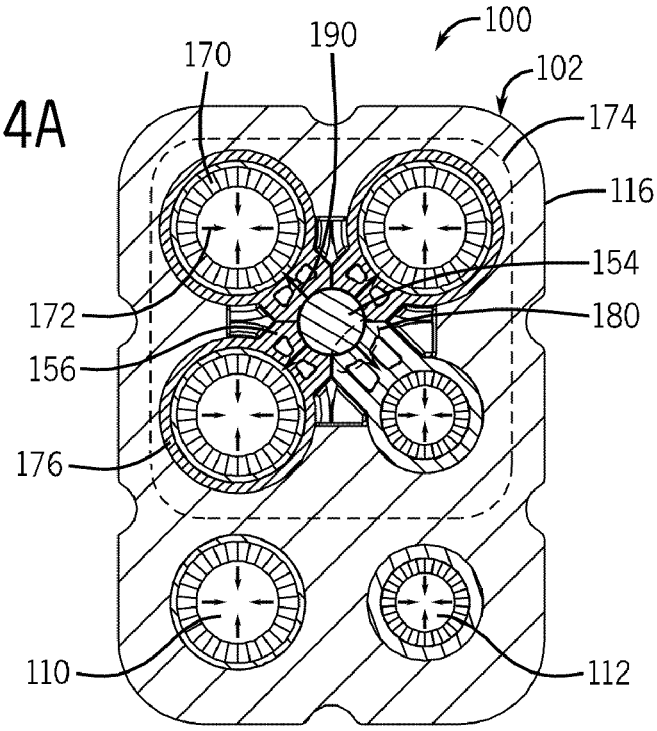
FIG. 24A is a cross-sectional view of the nose assembly of the aircraft electrical connector of FIG. 22, taken along a line 24-24 and illustrated in an engaged position.

Referring now to FIG. 24A, a cross-section viewed down the connection axis 136 of the nose assembly 102 is shown, taken across a line 24-24 from FIG. 22, wherein the aircraft electrical connector is illustrated as being in the locked position (trigger 118 released). As illustrated, the tapered portion 154 of the shaft 140 is in abutment with the quarter circle areas 180 of the collar protrusions 156. The taper of the shaft 140 is configured such that the shaft 140 is thinner at the end that enters into the nose assembly 102. During operation, as the handle 118 is released and the shaft taper 154 moves into the area 178, and the gradual increase in diameter of the shaft 140 causes the collar protrusions 156 to move radially outward, in a crosswise direction (e.g., radially diverging relationship) relative to the connection axis 136 of the connector 100. In such an embodiment, the biasing assembly 104 could be considered as being engaged.

As the biasing assembly 104 begins to be engaged, the collar protrusions 156 cause the collars 176 (and thus the positionally biased electrical connectors 110, 112) to move in a radially diverging manner, exerting a force 190 on the male electrical connectors 20 of the aircraft in a crosswise (perpendicular) relation to the longitudinal axis of the male electrical connectors 20, which is generally parallel to the connection axis 136. When the biasing assembly 104 is fully engaged (i.e., the shaft 140 has been fully abutted against the collar protrusions 156 and the spring 142 has been fully released), the force exerted on the male electrical connectors 20 may be between about 10 lbs and about 20 lbs per connector (e.g., about 15 lbs). In the illustrated embodiment, the biasing assembly 104 biases four of the six electrical connectors 110, 112. However, in other embodiments, less or more than four connectors 110, 112 may be biased, as described below. In one embodiment, the sum of all forces exerted on the male electrical connectors 20 as a result of the biasing assembly 104 and the annular structures 170 (the sum force exerted on all six male electrical connectors 20) may be considered the overall retention force. In some embodiments, the overall retention force may be between about 60 lbs and about 100 lbs (e.g., about 80 lbs±20 lbs).

It should be noted that while the biasing of the connectors 110, 112 is performed using collars 176, that any method of reversibly providing a force to a connector, such as connectors 110, 112, and 20 in a perpendicular direction relative to a longitudinal axis (such as connection axis 136) of the connector to give differential retention and insertion forces is also contemplated. Such forces may include providing a lateral force (e.g., crosswise) on one or more of the male electrical connectors 20 (e.g., pins), for example forces 190. For example, the lateral force may include squeezing, clasping, gripping, pushing, pressing, or compressing a single male electrical connector 20, either directly or indirectly through the female connector 110, 112 (e.g., connector sockets). By further example, the lateral force may include squeezing, clasping, gripping, pushing, pressing, or compressing a plurality of the male electrical connectors 20, either directly or indirectly through the female connector 110, 112. As another example, the lateral force may include squeezing, clasping, gripping, pushing, pressing, or compressing at least one of the male electrical connectors 20, either directly or indirectly through the female connector 110, 112, relative to at least one or more other male connectors 20. The lateral forces may cause movement of the male connectors 20 toward or away from one another, or the lateral forces may bias one or more male connectors 20 without causing any substantial movement of the male connectors 20.

Further, if the retention force is not a result of biasing of multiple electrical connectors 110, 112, then the total retention force may arise from providing a force to a single connector 20, such that the total retention force on the single connector 20 is approximately 80 lbs±20 lbs, or may arise from providing forces to multiple connectors, such as two, three, four, five, or six connectors 20. Nevertheless, the sum retention force, according to present embodiments, may be approximately 80 lbs±20 lbs. Likewise, if the retention force does result from connector movement, then the retention force may be provided as the biasing of two, three, four, five, or six connectors 110, 112 in relation to one another, with the overall retention force being approximately 80 lbs±20 lbs. In some embodiments, the provision of forces using the approaches described herein may allow a connector, such as connector 100, to maintain a retention force of approximately 80 lbs±20 lbs after 500, 1000, 1500 or 2000 connections. However, it should be understood that various embodiments may employ different ranges of retention forces, different numbers and configurations of connectors, and so forth.

Figure 24B:
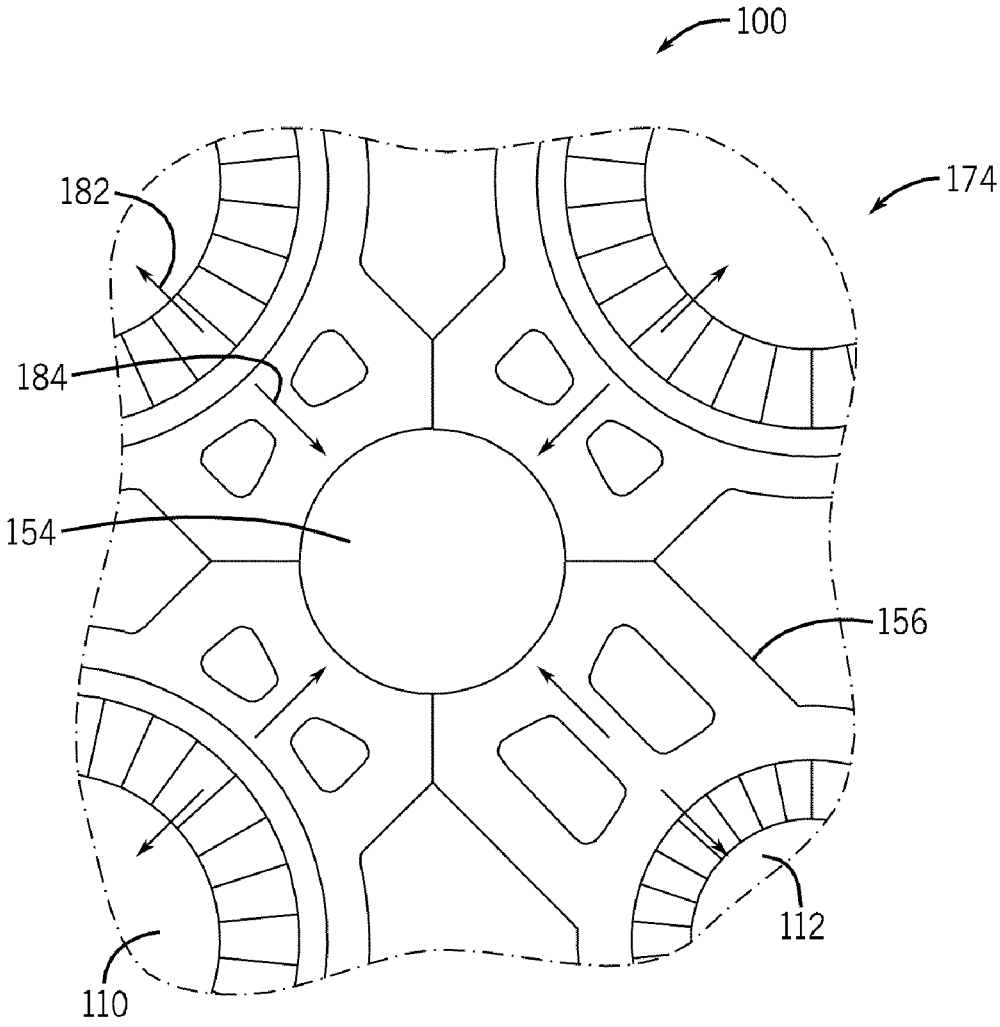
FIG. 24B is an enlarged cross-sectional view of a portion of the nose assembly of the aircraft electrical connector of FIG. 24A, illustrated in an engaged position.

FIG. 24B is an expanded view of FIG. 24A illustrating the directional movement of the collar protrusions 156 during engagement and disengagement of the biasing assembly 104. In the illustrated embodiment, an outward direction 182 and an inward direction 184 are depicted, which result from abutment of the tapered section 154 against the collar protrusions of connectors 110, 112. For example, when the biasing assembly 104 is engaged, the tapered section 154 abuts against collar protrusions 156, causing lateral movement of the collar protrusions 156 (and thus, the connectors 110, 112) in the outward, radially diverging direction 182. Conversely, when the biasing assembly is disengaged, for example when the handle 118 is depressed, the collar protrusions 156 and thus the connectors 110, 112 move in the converging, radially inward direction 184. It should be noted that when the collar protrusions 156 move in the outward direction 182, that the connectors 110, 112 may abut directly against the male connectors 20, leading to a higher retention force than when the collar protrusions 156 move in the inward direction 184, which may lead to a substantial alignment of the connectors 110, 112 with the male connectors 20.

Figure 25:
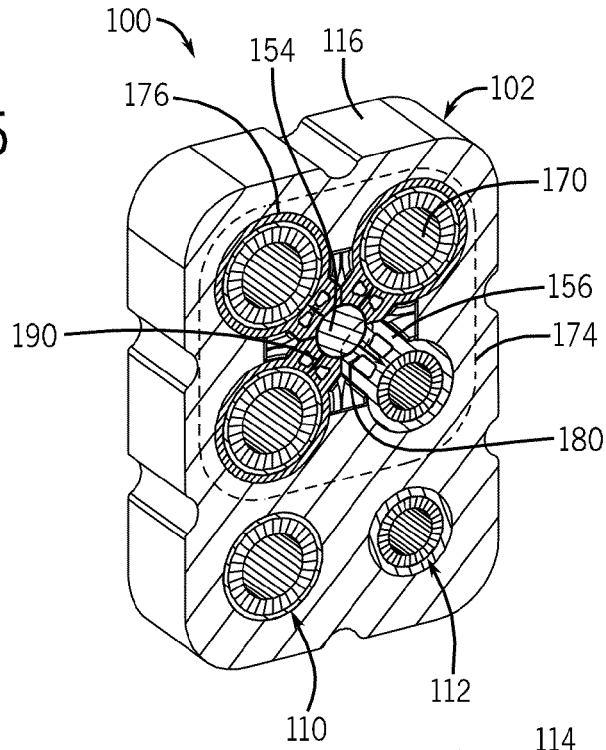
FIG. 25 is a perspective, cross-sectional view of the nose assembly of FIG. 24, illustrated in an engaged position and displaying features consistent with the unique collar assembly.

Moving now to FIG. 25, a perspective view of the cross section shown in FIG. 24 is illustrated. As depicted, the perspective view shows the configuration of the electrical connectors 110, 112 which include, among other features, the inner, circumferentially-disposed annular springs 170. The annular springs 170, as depicted, are multi-lams displaying a striated structure which generally bow in towards the center of each connector 110, 112. This bow contributes to the forces 172 which define the overall insertion force needed for the aircraft electrical connector 100. Further, in embodiments where the annular springs 170 are coiled and protrude towards the center of each connector 110, 112, the friction between the springs 170 and the male electrical connectors 20 of the aircraft may also contribute to the overall insertion force required. Indeed, the annular springs 170 may have many configurations, and any annular structure is contemplated wherein the structure is electrically conductive and exerts a force inwardly towards the center of each connector 110, 112 and against an inserted electrical connector. It should be noted, as well, that the annular springs 170 should display some level of wear resistance, due to the repeated movement of the connectors 110, 112 and their constant abutment against the male electrical connectors 20 when biasing is performed.

Figure 26:
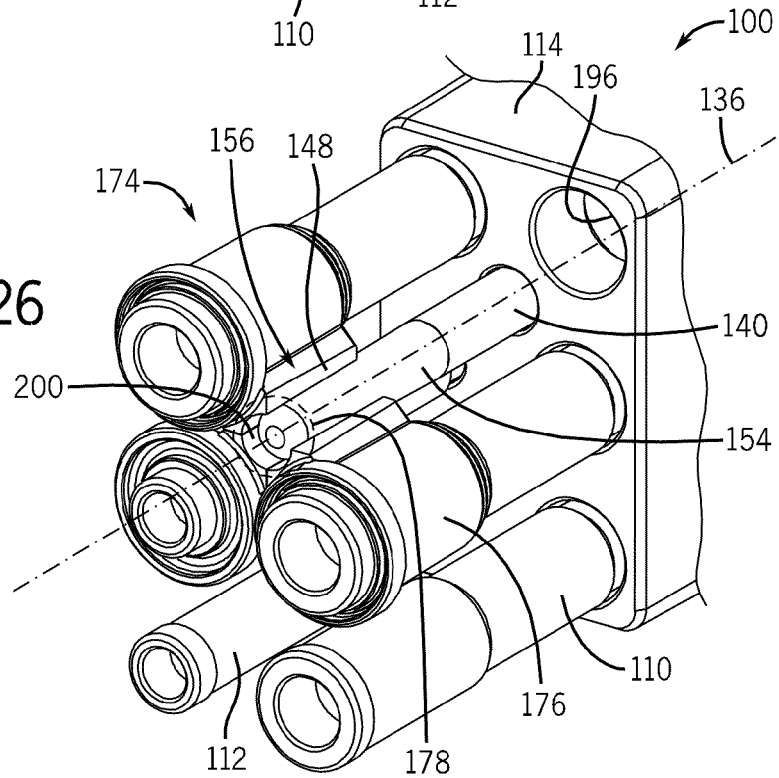
FIG. 26 is a perspective view of the unique collar assembly, illustrated between the engaged and disengaged positions and displaying features consistent with an aspect of the present techniques.

As illustrated, the collars 176 surround the biased connectors 110, 112 in a sleeve-like manner. Generally, the collars 176 extend from an approximately central portion of the connectors 110, 112 and out towards the connection end of the nose 116, as is shown in FIG. 26. As depicted, a connector 110 has been removed from an annular opening 196 to further reveal features of the collar assembly 174. The annular opening 196 may include features that allow the connectors 110, 112 to be removably secured to the interface housing 114 via a mating connection. For example, the connectors 110, 112 may be threadingly engaged with the interface housing 114 via a socket, such as a cam socket head cap screw disposed on a rear surface of the connectors 110, 112.

Turning to the collar assembly 174, the collar protrusions 156, in some embodiments, may display a taper 198 (indicated as a change in thickness from one side to another) similar to that of the tapered section 154 of the shaft 140. Accordingly, a surface 200 against which the tapered section 154 abuts may display an angle defined by the change in thickness of taper 198. For example, the angle of the surface 200 may be substantially the same as the angle of the tapered section 154. In one embodiment, the angle of the surface 200 may be defined as the angle of deviation from the connection axis 136 as measured at the forward section of the taper towards the nose 116. Similarly, the angle of the tapered section 154 may be defined as the angle of deviation from the same, but in the opposite direction (towards the cable assembly 106). As mentioned, the tapered section 154 may be a slight taper, such that the abutment of the shaft 140 with the collar protrusions 156 may result in a gradual, radially outward motion of the collars 170. For example, the tapered section 154 of the shaft 140 may have a taper of between about 0.5 percent and about 5 percent of the total diameter or circumference of the shaft 140. In one particular embodiment, the taper of the tapered section 154 is about 1 percent. In another embodiment, the degree of the taper 198 may be measured by the angle of deviation form the connection axis 136. In such an embodiment, the angle may be greater than 0 degrees and less than about 20 degrees. For example, the angle may be less than about 0.5, 1, 2, 3, 4, or 5 degrees. The taper 198 of the collar protrusions 156 may be slightly smaller than the tapered section 154 of the shaft 140, such that instead of abutting against a collar protrusion 156 having a generally flat annular surface, the shaft 140 may abut against the tapered surface 200. The configuration of the tapered shaft 140, in combination with the tapered surface 200, may allow the forces that result form abutment, such as the radially inward forces generated by the resistance to movement by the collars 176 and biased connectors 110, 112, to be applied to a larger surface of the shaft 140 than would otherwise be feasible with alternative configurations.

Figure 27:
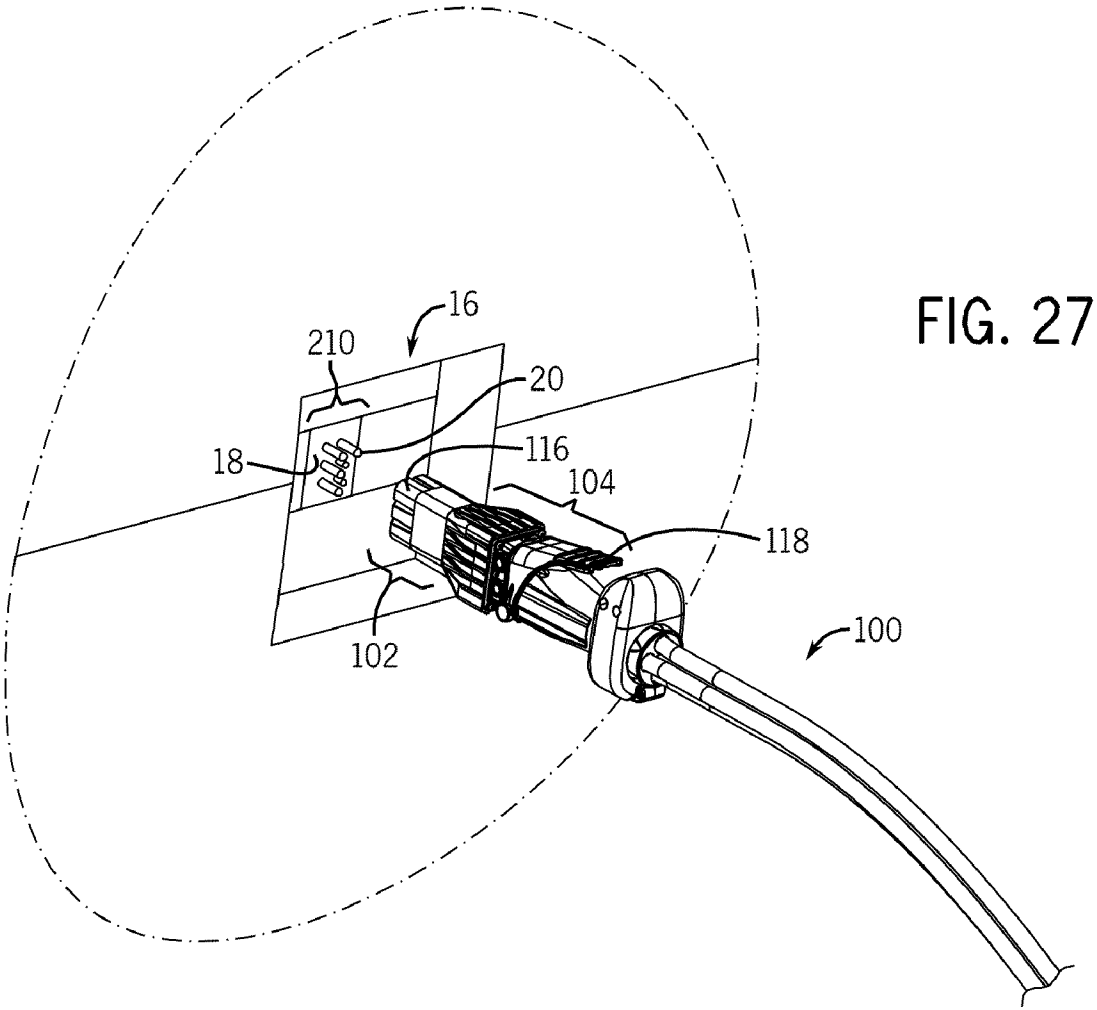
FIG. 27 is a perspective view of the aircraft electrical connector and onboard aircraft electrical connector as they approach each other during operation and illustrated in a disengaged position.

It should be noted that the collar assembly 174, being disposed towards the connecting end of the connectors 110, 112, may allow the retention forces that result from biasing the position of the collars 176 (and thus the connectors 110, 112) against the male connectors 20 of the aircraft to be applied close to the attachment points where the male connectors 20 protrude away from the aircraft. For example, the approach of the aircraft electrical connector 100 to male connectors 20 of an aircraft during operation is shown in FIG. 27. As depicted, the aircraft has the onboard aircraft electrical connector 16 generally including an engagement area 210 defining the male connectors 20 and the surface 18 from which the male connectors 20 protrude. The onboard aircraft electrical connector 16 initially engages the nose assembly 102 by aligning the long axis of the male connectors 20 with the connection axis 136 of the aircraft electrical connector 100. The male connectors 20 are then inserted into electrical connectors 110, 112 upon depression of the handle (trigger) 118 by an operator. When the handle 118 is released, the biasing assembly 104 acts upon the connectors 110, 112, 20 to generate the desired retention force. Again, the biasing assembly 104 forces crosswise or radial movement of one or more connectors 110, 112, thereby creating crosswise forces between the female connectors 110, 112 and the male connectors 20. The replaceable nose 116, being constructed from a robust polymeric material, ensures that abutment of the connector 100 against the aircraft does not cause any damage to the surface 18 or the connectors 110, 112. As mentioned, the placement of the collars 176 towards the connection end of the connectors 110, 112 allow the placement of retention forces close to the surface 18. Such placement may allow a more secure retention than would be available using conventional aircraft electrical connectors, which typically apply their retention forces at the forward end (away from the surface 18).

Figure 28:
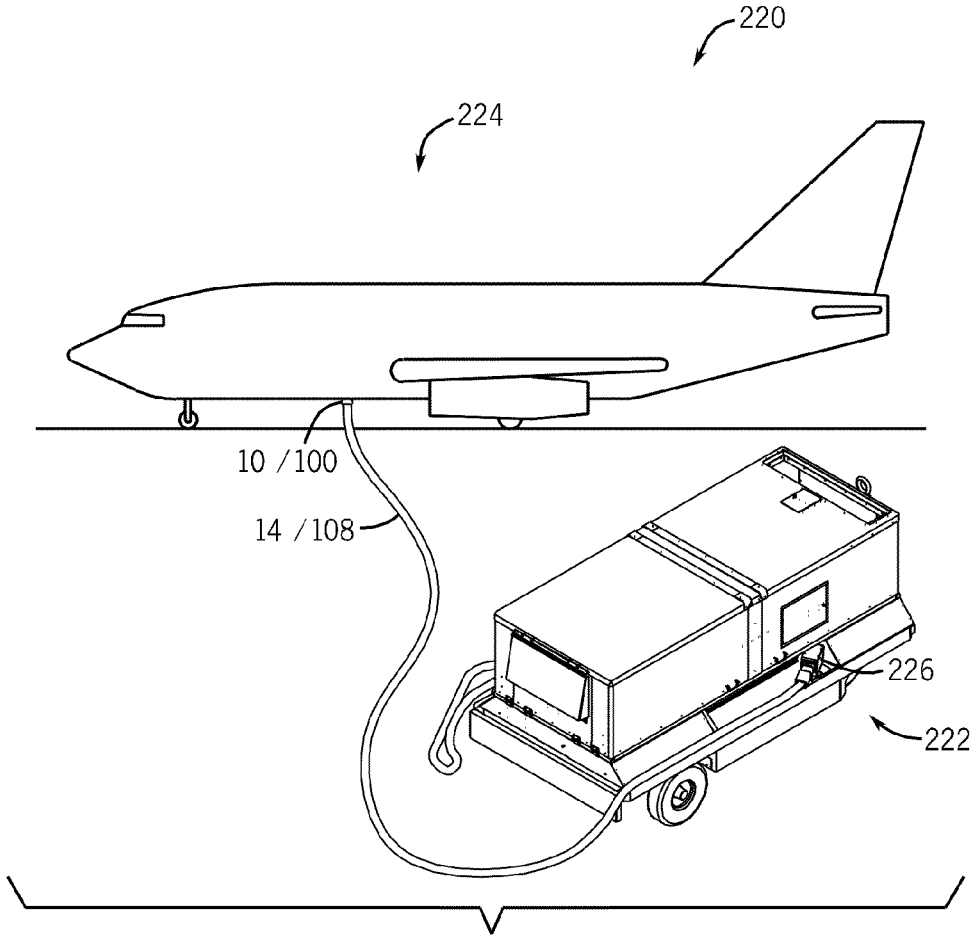
FIG. 28 is a perspective view of a ground support power system utilizing the unique aircraft electrical connector for powering an aircraft during servicing in accordance with an aspect of the present technique.

Referring now to FIG. 28, an illustration of one embodiment of a ground support power system 220 that provides power from a ground power unit 222 to an aircraft 224 upon connection of the connectors 10, 100 to the onboard aircraft electrical connector 16 is depicted. The illustrated ground power unit 222 is a mobile vehicle having an onboard power supply, which provides power to the aircraft 224 through the power cable 14, 108 extending from the ground power unit 222 to the aircraft 224. The power cable 14, 108 is releasably coupleable to the ground power unit 222 and the aircraft 224 at electrical connectors 10, 100 and 226, respectively. Although the present techniques have been described with respect to an aircraft electrical connector (10, 100), the methods used herein may also be applicable to the connector 226, which may incorporate unique aspects of the present technique, as described above with respect to differential retention and insertion forces. In operation, one or all of the electrical connectors 10, 100 and 226 may prevent inadvertent release via motion or tension in the power cable 14, 108. However, excessive movement of the ground power unit 222 or the aircraft 224 or a critical event sensed in the ground power unit 222 or the aircraft 224 may cause the connectors 10, 100, and/or 226 to release.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

an aircraft electrical connector, comprising:

a first electrical connector;

a second electrical connector;

a third electrical connector; and a trigger configured to move the first, second, and third electrical connectors in a radially converging relationship and a radially diverging relationship relative to one another between a first configuration and a second configuration, wherein the first, second, and third electrical connectors have respective first retention forces in the first configuration and respective second retention forces in the second configuration, and the second retention forces are greater than the first retention forces.

2. The system of claim 1, comprising a biasing mechanism responsive to the trigger, wherein the biasing mechanism is configured to move the first electrical connector in a first direction crosswise to a connection axis of the aircraft electrical connector, and the biasing mechanism is configured to move the second electrical connector in a second direction crosswise to the connection axis of the aircraft electrical connector.

3. The system of claim 2, wherein the first and second directions are opposite from one another.

4. The system of claim 2, wherein the biasing mechanism comprises a shaft having a biasing portion and a first sleeve having a first tapered portion, the first sleeve is disposed about the first electrical connector, and the biasing portion interfaces with the first tapered portion.

5. The system of claim 1, wherein the first electrical connector comprises a first female connector having a first connector receptacle and an annular spring disposed circumferentially about the first connector receptacle.

6. The system of claim 1, wherein the trigger comprises a depressed position corresponding to the first configuration and a released position corresponding to the second configuration, wherein the aircraft electrical connector comprises a spring biasing the trigger from the depressed position toward the released position.

7. The system of claim 1, wherein the aircraft electrical connector comprises fourth, fifth, and sixth electrical connectors generally parallel with the first, second, and third electrical connector and a connection axis, wherein the trigger is configured to move the first, second, third, and fourth electrical connectors in the radially converging relationship and the radially diverging relationship relative to one another.

8. The system of claim 7, wherein the aircraft electrical connector comprises a shaft positioned substantially centrally between the first, second, third, and fourth electrical connectors and oriented generally parallel to the connection axis, wherein the trigger is configured to move the shaft axially along the connection axis, wherein a tapered interface between the shaft and the first, second, third, and fourth electrical connectors is configured to cause movement of the first, second, third, and fourth electrical connectors in the radially converging relationship and the radially diverging relationship in response to axial movement of the shaft.

9. A system, comprising:

an aircraft electrical connector, comprising:

a first electrical connector configured to mate in a connection direction with a first mating electrical connector in a first pin into socket coaxial arrangement;

a second electrical connector configured to mate in the connection direction with a second mating electrical connector in a second pin into socket coaxial arrangement;

a biasing mechanism comprising a shaft configured to bias the first and second electrical connectors in first and second directions crosswise relative to the connection direction, wherein the shaft is configured to move generally along the connection direction; and a trigger coupled to the biasing mechanism.

10. The system of claim 9, wherein the first electrical connector and the first mating electrical connector are disposed one inside another in the first in into socket coaxial arrangement, and the second electrical connector and the second mating electrical connector are disposed one inside another in the second pin into socket coaxial arrangement.

11. The system of claim 9, wherein the first and second directions are opposite from one another.

12. The system of claim 11, wherein the aircraft electrical connector comprises a third electrical connector configured to mate in the connection direction with a third mating electrical connector in a third pin into socket coaxial arrangement, the aircraft electrical connector comprises a fourth electrical connector configured to mate in the connection direction with a fourth mating electrical connector in a fourth in into socket coaxial arrangement, the shaft is configured to bias the third electrical connector in a third direction crosswise relative to the connection direction, the shaft is configured to bias the fourth electrical connector in a fourth direction crosswise relative to the connection direction, and the third and fourth directions are opposite from one another.

13. The system of claim 12, wherein the first, second, third, and fourth electrical connectors each comprise a female connector having an annular spring disposed about a connector receptacle.

14. The system of claim 12, wherein the biasing mechanism comprises a tapered interface configured to gradually bias the first, second, third, and fourth electrical connectors in a radially converging relationship and a radially diverging relationship relative to one another in response to movement of the trigger.

15. The system of claim 9, comprising:

a first biasing sleeve disposed about the first electrical connector, wherein the first biasing sleeve comprises a first tapered surface having a first angle relative to the connection direction;

a second biasing sleeve disposed about the second electrical connector, wherein the second biasing sleeve comprises a second tapered surface having a second angle relative to the connection direction;

a third biasing sleeve disposed about a third electrical connector, wherein the third biasing sleeve comprises a third tapered surface having a third angle relative to the connection direction;

a fourth biasing sleeve disposed about a fourth electrical connector, wherein the fourth biasing sleeve comprises a fourth tapered surface having a fourth angle relative to the connection direction;

wherein the shaft comprises a tapered biasing surface having a biasing angle relative to the connection direction;

wherein the shaft and the first, second, third, and fourth electrical connectors have axes that are generally parallel to the connection direction;

wherein the shaft is disposed centrally between the first, second, third, and fourth electrical connectors; and wherein the tapered biasing surface is configured to interface with the first, second, third, and fourth tapered surfaces to radially bias the first, second, third, and fourth electrical connectors in a radially converging relationship and a radially diverging relationship relative to one another in response to movement of the trigger.

16. A system, comprising:

an aircraft electrical connector, comprising:

a first electrical connector configured to couple with a first mating connector at a connecting end;

a second electrical connector configured to couple with a second mating connector at the connecting end;

a third electrical connector configured to couple with a third mating connector at the connecting end;

a biasing mechanism configured to move the first, second, and third electrical connectors in crosswise directions relative to a connection axis between a first configuration and a second configuration, wherein the first configuration has respective first retention forces between the first, second, and third electrical connectors and the respective first, second, and third mating connectors, the second configuration has respective second retention forces between the first, second, and third electrical connectors and the respective first, second, and third mating connectors, and the second retention forces are greater than the first retention forces; and a trigger coupled to the biasing mechanism.

17. The system of claim 16, wherein the first, second, and third electrical connectors are disposed generally along the connection axis running substantially axially through the aircraft electrical connector; and wherein the biasing mechanism comprises:

a cam member disposed proximate the first, second, and third electrical connectors, the cam member is movably connected to the trigger and has an axis of rotation substantially perpendicular to the connection axis;

wherein the cam member is configured to rotatably abut against the first, second, and third mating connectors when moving from the first configuration to the second configuration, wherein the trigger is configured to engage the cam member between the first and second configurations.

18. The system of claim 16, wherein the first electrical connector is disposed along the connection axis running axially through the aircraft electrical connector; and wherein the biasing mechanism comprises:

a shaft movably extending through the aircraft electrical connector along the connection axis and having a tapered section, the shaft being movably connected to the trigger;

a spring disposed circumferentially around the shaft and configured to axially bias the shaft along the connection axis towards the connecting end and bias the trigger towards a released position; and a first sleeve having a first tapered protrusion, the first sleeve being disposed circumferentially about the first electrical connector, the first tapered protrusion is configured to interface with the tapered section of the shaft to produce a force substantially perpendicular to the first electrical connector and the first mating connector when moving from the first configuration to the second configuration upon releasing the trigger.

19. The system of claim 18, wherein the aircraft electrical connector comprises fourth, fifth, and sixth electrical connectors generally parallel with the first, second, and third electrical connectors and the connection axis, wherein the second, third, and fourth electrical connectors each have a sleeve with a tapered protrusion, wherein the trigger is configured to move the shaft along a tapered interface between the tapered section of the shaft and the tapered protrusions resulting in movement of the first, second, third, and fourth electrical connectors in a radially converging relationship and a radially diverging relationship relative to one another, wherein the shaft is positioned substantially centrally between the first, second, third, and fourth electrical connectors, wherein the movement in the radially converging relationship and the radially diverging relationship is in response to axial movement of the shaft between the first and second configurations.

* * * * *